US011683634B1

(12) United States Patent
Yang

(10) Patent No.: US 11,683,634 B1
(45) Date of Patent: Jun. 20, 2023

(54) JOINT SUPPRESSION OF INTERFERENCES IN AUDIO SIGNAL

(71) Applicant: Meta Platforms Technologies, LLC, Menlo Park, CA (US)

(72) Inventor: Jun Yang, San Jose, CA (US)

(73) Assignee: Meta Platforms Technologies, LLC, Menlo Park, CA (US)

( * ) Notice: Subject to any disclaimer, the term of this patent is extended or adjusted under 35 U.S.C. 154(b) by 6 days.

(21) Appl. No.: 17/100,281

(22) Filed: Nov. 20, 2020

(51) Int. Cl.
*H04R 1/22* (2006.01)
*H04R 1/28* (2006.01)

(52) U.S. Cl.
CPC ..... *H04R 1/222* (2013.01); *H04R 1/28* (2013.01)

(58) Field of Classification Search
CPC ..... H04R 1/222; H04R 1/028; H04R 1/1083
See application file for complete search history.

(56) References Cited

U.S. PATENT DOCUMENTS 5,742,694 A * 4/1998 Eatwell ..... H04B 1/123 381/94.2
10,991,378 B2 * 4/2021 Rosenkranz ..... G10L 15/26
2008/0159573 A1 * 7/2008 Dressier ..... H04R 25/505 381/317
2012/0082322 A1 * 4/2012 van Waterschoot ..... G10L 21/0316 381/92
2015/0071461 A1 * 3/2015 Thyssen ..... G10L 21/0208 381/94.1
2017/0013373 A1 * 1/2017 Tessendorf ..... H04R 25/554
2021/0098015 A1 * 4/2021 Pandey ..... H04R 3/005
2021/0343307 A1 * 11/2021 Namba ..... G10L 21/0216
2021/0400373 A1 * 12/2021 Marti ..... H04R 1/1083

OTHER PUBLICATIONS

Habets, E. A. P. "Single- and Multi-Microphone Speech Dereverberation using Spectral Enhancement." Dissertation, Eindhoven University of Technology, Jun. 25, 2007, pp. 1-257.

* cited by examiner

*Primary Examiner* — Jason R Kurr
(74) *Attorney, Agent, or Firm* — Fenwick & West LLP

(57) ABSTRACT

A system that suppresses a plurality of interferences of different types in a received audio signal. The system comprises one or more microphones and an audio controller. The one or more microphones are configured to detect the audio signal. The audio controller applies an interference estimation algorithm to the audio signal to generate an attenuation coefficient for each of the plurality of interferences of different types. The audio controller applies the attenuation coefficients to the audio signal to generate an interference-suppressed audio signal in which the plurality of interferences of different types is suppressed. The audio controller determines a time domain signal based on the interference-suppressed audio signal to provide to an end user.

20 Claims, 7 Drawing Sheets

JOINT SUPPRESSION OF INTERFERENCES IN AUDIO SIGNAL

FIELD OF THE INVENTION

This disclosure relates generally to an audio system, and more specifically to joint suppression of a plurality of interferences in an audio signal by the audio system.

BACKGROUND

Audio devices, such as video calling devices, digital assistant devices, computers, laptops, smartphones, wearable devices (e.g., hearing aids, smartwatches, etc.) are used for audio applications in environments that include different interferences (e.g., a wind interference, an echo interference, etc.). The different interferences may significantly degrade the quality of an audio signal received at the audio devices and reduce the performance of the audio applications.

SUMMARY

An audio system may be integrated into an electronic device (e.g., a headset, a laptop, a mobile device, a digital assistant, etc.) and utilized in a variety of audio applications (e.g., re-broadcast of sound, voice communications, voice-over internet protocol (VoIP), voice-trigger, etc.). The audio system may receive incoming audio signals that include a plurality of interferences of different types (e.g., wind interference, echo interference, etc.). Each interference of the plurality of interferences of different types is a sound emitted by one or more sounds sources in a local area that may negatively affect performance of the audio system during an audio application. The interferences may include, e.g., a wind interference, an echo interference, a stationary interference, etc. To suppress the plurality of interferences, the audio system applies an interference estimation algorithm to the audio signal to generate an attenuation coefficient for each of the plurality of interferences and applies the attenuation coefficients to the audio signal to generate an interference-suppressed audio signal in which the plurality of interferences have been suppressed. The audio system generates the attenuation coefficients for each of the plurality of interferences of different types jointly and applies the attenuation coefficients to the audio signal jointly.

In some embodiments, a method is described for jointly suppressing a plurality of interferences from an audio signal prior to providing the audio signal to an end user. The method includes detecting the audio signal with one or more microphones. The audio signal includes a plurality of interferences of different types. The method further includes applying an interference estimation algorithm to the audio signal to generate an attenuation coefficient for each of the plurality of interferences of different types. The method further includes applying the attenuation coefficients to the audio signal to generate an interference-suppressed audio signal in which the plurality of interferences of different types is suppressed. The method further includes determining a time domain signal based on the interference-suppressed audio signal to provide to an end user.

In some embodiments, a system is described that jointly suppresses a plurality of interferences of different types from an audio signal prior to providing the audio signal to an end user. The system comprises one or more microphones configured to detect an audio signal. The audio signal including a plurality of interferences of different types. The system further comprises an audio controller. The audio controller is configured to apply an interference estimation algorithm to the audio signal to generate an attenuation coefficient for each of the plurality of interferences of different types. The audio controller is further configured to apply the attenuation coefficients to the audio signal to generate an interference-suppressed audio signal in which the plurality of interferences of different types is suppressed. The audio controller is further configured to determine a time domain signal based on the interference-suppressed audio signal to provide to an end user. Also described are embodiments of non-transitory computer-readable storage mediums configured to store instructions for performing the methods of this disclosure.

Figure 1A:
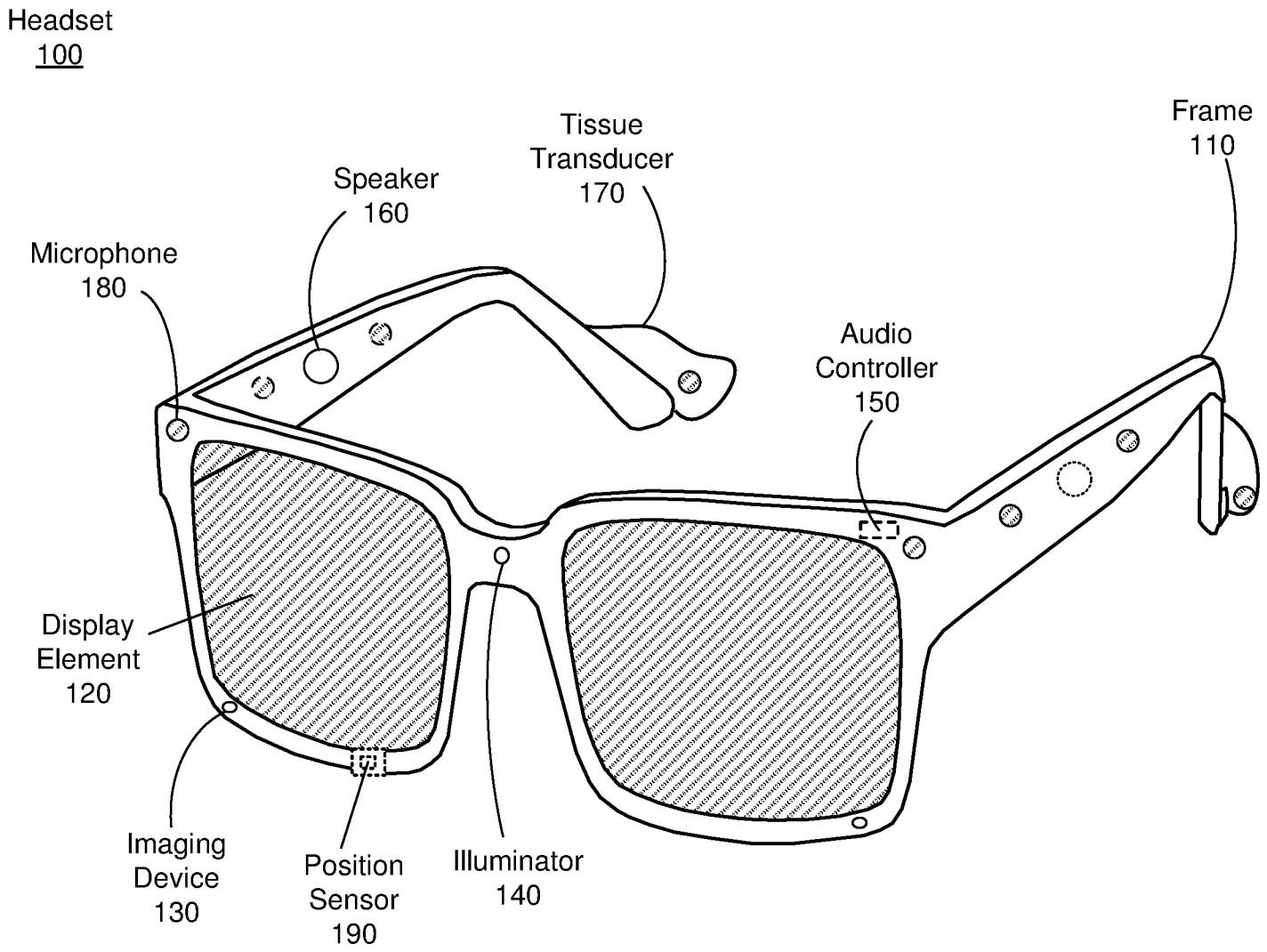
FIG. 1A is a perspective view of a headset implemented as an eyewear device, in accordance with one or more embodiments.

The figures depict various embodiments for purposes of illustration only. One skilled in the art will readily recognize from the following discussion that alternative embodiments of the structures and methods illustrated herein may be employed without departing from the principles described herein.

DETAILED DESCRIPTION

An audio system may be integrated into a variety of different electronic devices. The electronic devices may include video calling devices, digital assistant devices, mobile devices, headsets, computers, laptops, wearable devices (e.g., hearing aids, smartwatches, etc.), or any other suitable electronic device. The electronic devices may be utilized in indoor and/or outdoor locations. The electronic devices may perform various audio applications for a user, such as barge-in, voice-trigger, automatic speech recognition (ASR), voice communication, voice over internet protocol (VoIP), re-broadcast of sounds, etc. An incoming audio signal of the electronic device may include a plurality of interferences of different types. The interferences may have a negative effect on the audio application of the device (e.g., by reducing speech quality and intelligibility of the audio signal). The negative effects may degrade performance of the audio system. Types of interferences may include a wind interference, an echo interference, a reverberation interference, a nonstationary interference, and a stationary interference. To improve performance of the audio applications of the electronic device, the audio system suppresses the plurality of interferences in the received audio signal.

The audio system may apply an interference estimation algorithm to the audio signal to generate an attenuation coefficient for each of the plurality of interferences of different types. The audio system may apply the attenuation coefficients to the audio signal to generate an interference-suppressed audio signal in which the plurality of interferences of different types is suppressed. The audio system generates the attenuation coefficients for each of the plurality of interferences of different types jointly and applies the attenuation coefficients to the audio signal jointly.

Current audio systems suppress sounds (e.g., interferences) in an audio signal independently. Typically, designing an algorithm for each interference and integrating them into a system as separate components without any cross-component processing. As such, the current audio systems are computationally complex requiring large amounts of memory and slow processing times. The interference-suppressed audio signal from current audio systems suffer from non-optimum performance, e.g., these systems fail to provide desired suppression and/or the desired audio signal enhancement when sounds associated with interferences are present at the same time as a desired sound (e.g., human speech). The audio system described herein reduces memory, latency, and computational complexity, and globally optimizes speech performance due to a parallel (joint) suppression of sounds in an audio signal associated with interferences of different types.

Embodiments of the invention may include or be implemented in conjunction with an artificial reality system. Artificial reality is a form of reality that has been adjusted in some manner before presentation to a user, which may include, e.g., a virtual reality (VR), an augmented reality (AR), a mixed reality (MR), a hybrid reality, or some combination and/or derivatives thereof. Artificial reality content may include completely generated content or generated content combined with captured (e.g., real-world) content. The artificial reality content may include video, audio, haptic feedback, or some combination thereof, any of which may be presented in a single channel or in multiple channels (such as stereo video that produces a three-dimensional effect to the viewer). Additionally, in some embodiments, artificial reality may also be associated with applications, products, accessories, services, or some combination thereof, that are used to create content in an artificial reality and/or are otherwise used in an artificial reality. The artificial reality system that provides the artificial reality content may be implemented on various platforms, including a wearable device (e.g., headset) connected to a host computer system, a standalone wearable device (e.g., headset), a mobile device or computing system, or any other hardware platform capable of providing artificial reality content to one or more viewers.

FIG. 1A is a perspective view of a headset 100 implemented as an eyewear device, in accordance with one or more embodiments. In some embodiments, the eyewear device is a near eye display (NED). In general, the headset 100 may be worn on the face of a user such that content (e.g., media content) is presented using a display assembly and/or an audio system. However, the headset 100 may also be used such that media content is presented to a user in a different manner. Examples of media content presented by the headset 100 include one or more images, video, audio, or some combination thereof. The headset 100 includes a frame, and may include, among other components, a display assembly including one or more display elements 120, a depth camera assembly (DCA), a passive camera assembly (PCA), an audio system, and a position sensor 190. While FIG. 1A illustrates the components of the headset 100 in example locations on the headset 100, the components may be located elsewhere on the headset 100, on a peripheral device paired with the headset 100, or some combination thereof. Similarly, there may be more or fewer components on the headset 100 than what is shown in FIG. 1A.

The frame 110 holds the other components of the headset 100. The frame 110 includes a front part that holds the one or more display elements 120 and end pieces (e.g., temples) to attach to a head of the user. The front part of the frame 110 bridges the top of a nose of the user. The length of the end pieces may be adjustable (e.g., adjustable temple length) to fit different users. The end pieces may also include a portion that curls behind the ear of the user (e.g., temple tip, ear piece).

The one or more display elements 120 provide light to a user wearing the headset 100. As illustrated the headset includes a display element 120 for each eye of a user. In some embodiments, a display element 120 generates image light that is provided to an eyebox of the headset 100. The eyebox is a location in space that an eye of the user occupies while wearing the headset 100. For example, a display element 120 may be a waveguide display. A waveguide display includes a light source (e.g., a two-dimensional source, one or more line sources, one or more point sources, etc.) and one or more waveguides. Light from the light source is in-coupled into the one or more waveguides which outputs the light in a manner such that there is pupil replication in an eyebox of the headset 100. In-coupling and/or outcoupling of light from the one or more waveguides may be done using one or more diffraction gratings. In some embodiments, the waveguide display includes a scanning element (e.g., waveguide, mirror, etc.) that scans light from the light source as it is in-coupled into the one or more waveguides. Note that in some embodiments, one or both of the display elements 120 are opaque and do not transmit light from a local area around the headset 100. The local area is the area surrounding the headset 100. For example, the local area may be a room that a user wearing the headset 100 is inside, or the user wearing the headset 100 may be outside and the local area is an outside area. In this context, the headset 100 generates VR content. Alternatively, in some embodiments, one or both of the display elements 120 are at least partially transparent, such that light from the local area may be combined with light from the one or more display elements to produce AR and/or MR content.

In some embodiments, a display element 120 does not generate image light, and instead is a lens that transmits light from the local area to the eyebox. For example, one or both of the display elements 120 may be a lens without correction (non-prescription) or a prescription lens (e.g., single vision, bifocal and trifocal, or progressive) to help correct for defects in a user's eyesight. In some embodiments, the display element 120 may be polarized and/or tinted to protect the user's eyes from the sun.

Note that in some embodiments, the display element 120 may include an additional optics block (not shown). The optics block may include one or more optical elements (e.g., lens, Fresnel lens, etc.) that direct light from the display element 120 to the eyebox. The optics block may, e.g., correct for aberrations in some or all of the image content, magnify some or all of the image, or some combination thereof.

In some embodiments, the headset 100 may include one or more imaging devices 130 that capture visual information for the local area surrounding the headset 100. In some embodiments, the imaging devices 130 are utilized by a depth camera assembly (DCA). The DCA determines depth information for a portion of a local area surrounding the headset 100. The DCA includes one or more imaging devices 130 and a DCA controller (not shown in FIG. 1A) and may also include an illuminator 140. In some embodiments, the illuminator 140 illuminates a portion of the local area with light. The light may be, e.g., structured light (e.g., dot pattern, bars, etc.) in the infrared (IR), IR flash for time-of-flight, etc. In some embodiments, the one or more imaging devices 130 capture images of the portion of the local area that include the light from the illuminator 140. As illustrated, FIG. 1A shows a single illuminator 140 and two imaging devices 130. In alternate embodiments, there is no illuminator 140 and at least two imaging devices 130.

The DCA controller computes depth information for the portion of the local area using the captured images and one or more depth determination techniques. The depth determination technique may be, e.g., direct time-of-flight (ToF) depth sensing, indirect ToF depth sensing, structured light, passive stereo analysis, active stereo analysis (uses texture added to the scene by light from the illuminator 140), some other technique to determine depth of a scene, or some combination thereof.

The position sensor 190 generates one or more measurement signals in response to motion of the headset 100. The position sensor 190 may be located on a portion of the frame 110 of the headset 100. The position sensor 190 may include an inertial measurement unit (IMU). Examples of position sensor 190 include: one or more accelerometers, one or more gyroscopes, one or more magnetometers, another suitable type of sensor that detects motion, a type of sensor used for error correction of the IMU, or some combination thereof. The position sensor 190 may be located external to the IMU, internal to the IMU, or some combination thereof.

In some embodiments, the headset 100 may provide for simultaneous localization and mapping (SLAM) for a position of the headset 100 and updating of a model of the local area. For example, the headset 100 may include a passive camera assembly (PCA) that generates color image data. The PCA may include one or more imaging devices 130 (e.g., RGB cameras) that capture images of some or all of the local area and a PCA controller (not shown in FIG. 1A). The images captured by the PCA and the depth information determined by the DCA may be used to determine positional information about one or more sound sources in the local area (i.e. where a sound source is located within the local area), generate a model of the local area that includes the position of a sound source, update the model of the local area over time (i.e., update the model as one or more sound sources change position), or some combination thereof. Furthermore, the position sensor 190 tracks the position (e.g., location and pose) of the headset 100 in the model of the local area. In some embodiments, the model of the local area is stored in the headset (e.g., in the audio system), in an external system (e.g., a mapping server), in a mobile device, or in any combination thereof.

In some embodiments, the PCA controller may identify a type of sound source for each real-world sound source in the local area using the captured images and an object recognition model. A type of sound source is a classification of the entity emitting sound in the local area. For example, the PCA controller may use object recognition to identify the type of a real-world sound source to be, e.g., a person, a person wearing a headset, a speaker, an animal, a mechanical device, some other real-world entity emitting sound in the local area, or some combination thereof. The PCA controller may update the model of the local area to include the type of each sound source. The PCA controller may also update the model of the local area by tracking gestures performed by each person or person wearing a headset in the local area. A gesture may include talking, looking towards the user, looking towards a different person, waving, raising a hand, handing a real-world object to the user, or some other gesture performed by the person or person wearing a headset.

In some embodiments, the PCA may capture images of the user. The images captured by the PCA of the user may be used to update the model of the local area with gestures performed by the user. A gesture performed by the user is any movement that is indicative to a command (i.e., an implicit user input). A gesture performed by the user may include, e.g., a pointing gesture with the user's hand(s), finger(s), arm(s), some other movement performed by the user indicative of a command, or some combination thereof.

In some embodiments, the PCA controller may determine a location characteristic about the local area using the captured images and the object recognition model. A location characteristic of the local area provides location information about the local area. For example, the location characteristic may include location information, e.g., indoor versus outdoor. The PCA controller may use object recognition to identify real-world objects in the local area, e.g., walls, ceilings, windows, artwork, televisions, furniture, trees, clouds, cars, sidewalks, some other real-world objects in the local area, or some combination thereof. The PCA may determine the location characteristic of the local area as being indoor or being outdoor based on the identified real-world objects. For example, the PCA controller may determine the location characteristic of the local area as being indoor when the PCA controller identifies a couch, a television, a wall, and a ceiling in the captured images. The PCA controller may update the model of the local area to include the location characteristic of the local area.

The audio system provides audio content to the user via the headset 100. The audio system includes a microphone array, a transducer array, and an audio controller 150. However, in other embodiments, the audio system may include different and/or additional components. Similarly, in some cases, functionality described with reference to the components of the audio system can be distributed among the components in a different manner than is described here. For example, some or all of the functions of the controller may be performed by a remote server.

The microphone array detects sounds within the local area of the headset 100. The microphone array includes one or more microphones 180. The microphones 180 capture sounds emitted from one or more real-world sound sources in the local area (e.g., a room). The sounds may include a plurality of interferences of different types (e.g., a wind interference, an echo interference, a stationary interference, etc.). The microphones 180 may be acoustic wave sensors, sound transducers, or similar sensors that are suitable for detecting sounds. In some embodiments, one or more microphones 180 may be placed in an ear canal of each ear (e.g., acting as binaural microphones). The number and/or locations of microphones 180 may be different from what is shown in FIG. 1A. For example, the number of microphone locations may be increased to increase the amount of audio information collected and the sensitivity and/or accuracy of the information. The microphone locations may be oriented such that the microphone 180 is able to detect sounds in a wide range of directions surrounding the user wearing the headset 100. Each microphone 180 is configured to detect sounds and convert the detected sounds into an electronic format (analog or digital).

The transducer array may provide a time domain signal as audio content to the user (e.g., an end user of the audio system) of the headset 100. The transducer array includes a plurality of transducers. A transducer may be a speaker 160 or a tissue transducer 170 (e.g., a bone conduction transducer or a cartilage conduction transducer). The number and/or locations of speakers 160 may be different from what is shown in FIG. 1A. For example, the speakers 160 may be enclosed in the frame 110 of the headset 100. In some embodiments, instead of individual speakers for each ear, the headset 100 includes a speaker array comprising multiple speakers integrated into the frame 110 to improve directionality of presented audio content. The tissue transducer 170 couples to the head of the user and directly vibrates tissue (e.g., bone or cartilage) of the user to generate sound. The number and/or locations of transducers may be different from what is shown in FIG. 1A.

The audio controller 150 controls operation of the audio system. The audio controller 150 may comprise a processor and a computer-readable storage medium. In some embodiments, the audio controller 150 may apply an interference estimation algorithm to an audio signal detected by the one or more microphones 180 to generate an attenuation coefficient for each of the plurality of interferences of different types. The application of the interference estimation algorithm to the audio signal by the audio controller 150 is described further in FIG. 2.

The audio control 150 may apply the attenuation coefficients to the audio signal to generate an interference-suppressed audio signal in which the plurality of interferences is suppressed. The application of the attenuation coefficients to the audio signal to generate the interference-suppressed audio signal by the audio controller 150 is described further in FIG. 2

The audio controller 150 may determine a time domain signal based on the interference-suppressed audio signal to provide to the user via the transducer array as audio content. The determination of the time domain signal based on the interference-suppressed audio signal by the audio controller 150 is described further in FIG. 2.

Additional details regarding the audio system are discussed below in FIG. 2 and additional details regarding the components of the headset 100 are discussed below in connection with FIG. 5.

Figure 1B:
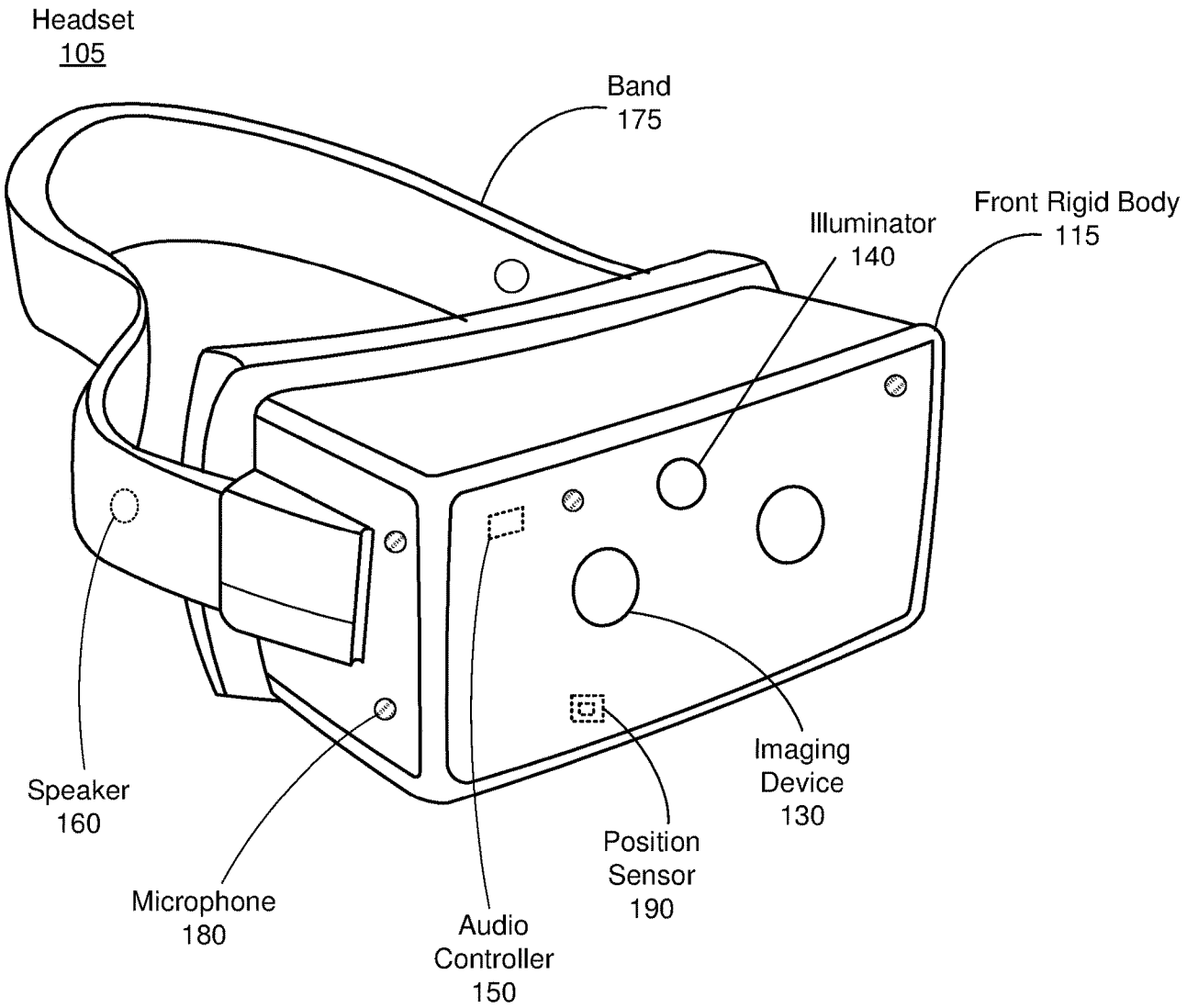
FIG. 1B is a perspective view of a headset implemented as a head-mounted display, in accordance with one or more embodiments.

FIG. 1B is a perspective view of a headset 105 implemented as an HMD, in accordance with one or more embodiments. In embodiments that describe an AR system and/or a MR system, portions of a front side of the HMD are at least partially transparent in the visible band (~380 nm to 750 nm), and portions of the HMD that are between the front side of the HMD and an eye of the user are at least partially transparent (e.g., a partially transparent electronic display). The HMD includes a front rigid body 115 and a band 175. The headset 105 includes many of the same components described above with reference to FIG. 1A but modified to integrate with the HMD form factor. For example, the HMD includes a display assembly, a DCA, a PCA, and an audio system. FIG. 1B shows the illuminator 140, a plurality of the speakers 160, a plurality of the imaging devices 130, a plurality of microphones 180, and the position sensor 190.

Figure 2:
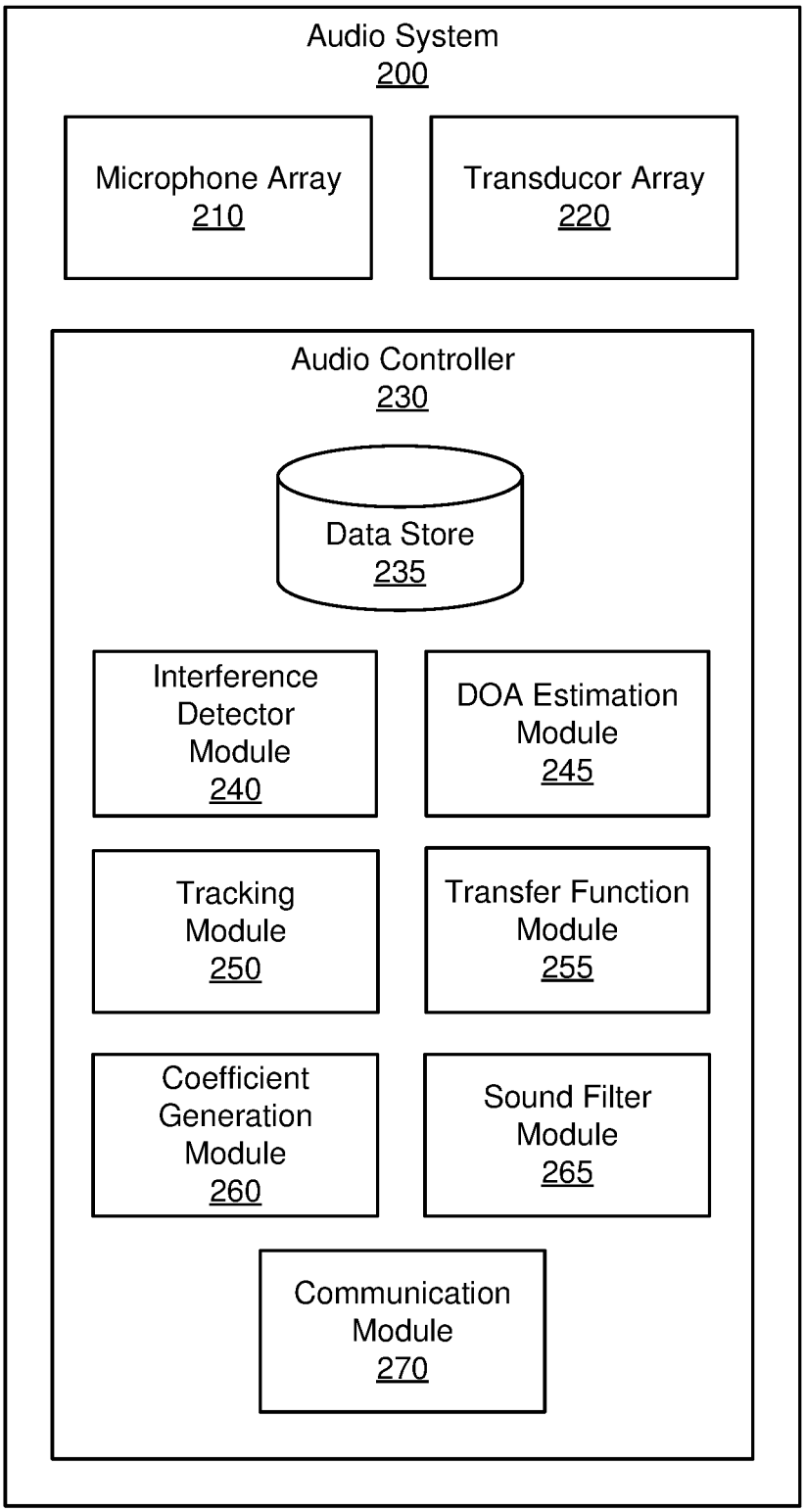
FIG. 2 is a block diagram of an audio system, in accordance with one or more embodiments.

FIG. 2 is a block diagram of an audio system 200, in accordance with one or more embodiments. The audio system in FIG. 1A or FIG. 1B may be an embodiment of the audio system 200. In other embodiments, the audio system 200 may be integrated in various different electronic devices, such as a video calling device, a digital assistant device, a computer, a laptop, a mobile phone, a wearable device (e.g., a hearing aid, a smartwatch, etc.), and any other suitable electronic device. In the embodiment of FIG. 2, the audio system 200 includes a microphone array 210, a transducer array 220, and an audio controller 230. Some embodiments of the audio system 200 have different components than those described here. Additionally, functionality described in conjunction with one or more of the components shown in FIG. 2 may be distributed amongst one or more external components. For example, some or all of the functionality of the audio controller 230 may be performed by a connected mobile device (e.g., a mobile phone).

The microphone array 210 detects real-world sounds within a local area surrounding the microphone array 210. The microphone array 210 may include a plurality of acoustic sensors that each detect air pressure variations of a sound wave and convert the detected sounds into an electronic format (e.g., a microphone signal for each acoustic sensor). The plurality of acoustic sensors may be positioned on the electronic device or some other connected device (e.g., a mobile phone), or some combination thereof. An acoustic sensor may be, e.g., a microphone, a vibration sensor, an accelerometer, or any combination thereof. By increasing the number of acoustic sensors, the accuracy of information (e.g., directionality) describing a sound field produced by any of the sound sources may be improved.

The microphone array 210 may capture sounds emitted by one or more real-world sound sources (including a user of the electronic device) within the local area. The captured sounds may include a plurality of interferences of different types. The interferences may cause negative effects to an end user's understanding of an audio signal. For example, the end user may misunderstand and/or misinterpret the audio signal. The different types of interferences may include a wind interference, an echo interference, a reverberation interference, a stationary interference, and a nonstationary interference. A wind interference is any sound caused by wind in the local area. Wind interference may be present during any outdoor application of the electronic device. An echo interference is any sound caused by an echo in the local area. Echo interference may be present during indoor or outdoor applications of the electronic device. Reverberation interference is any sound created by reverberations within the local area. Reverberation interference may be present during indoor applications of the electronic device. A nonstationary interference is any sound with an intensity, spectrum shape, mean, variance, or other characteristic that changes over time. Nonstationary interference may be present during indoor or outdoor applications. Examples of nonstationary interferences may be a plurality of people talking in the local area, phones ringing in the local area, music playing in the local area, televisions playing in the local area, airplane flying overhead in the local area, car horns honking in the local area, etc. A stationary interference is any sound with an intensity, spectrum shape, mean, variance, or other characteristic that remains unchanging as a function of time. Stationary interference may be present during indoor applications. Examples of stationary interferences may be an air conditioner hum, a fan motor, a dishwasher, a microwave hiss, etc.

The microphone signals are provided to the audio controller 230. The audio controller 230 may combine the microphone signals into the audio signal and perform further processing such as the application of attenuation coefficients to the audio signal to generate an interference-suppressed audio signal prior to determining a time domain signal based on the interference-suppressed audio signal to provide to an end user.

The end user is a receiver of the time domain signal. The end user may be a human listener or machine listener (e.g., the electronic device that the audio system is a component of). The end user of the audio system may be dependent upon the audio application (e.g., barge-in, voice-trigger, automatic speech recognition (ASR), voice communication, voice over internet protocol (VoIP), re-broadcast of sounds, etc.) being performed by the electronic device. For example, an electronic device (e.g., a headset device) is re-broadcasting sound to an end user. In this example, the end user may be the user wearing device. In another example, an electronic device (e.g., a digital assistant) is automatically recognizing speech emitted by a user of the electronic device. In this example, the end user may be the electronic device.

In some embodiments, the transducer array 220 provides the time domain signal as audio content to the end user (e.g., a user wearing a headset device). The transducer array 220 includes a plurality of transducers. A transducer may be, e.g., a speaker (e.g., the speaker 160), a tissue transducer (e.g., the tissue transducer 170), some other device that provides audio content, or some combination thereof. A tissue transducer may be configured to function as a bone conduction transducer or a cartilage conduction transducer. The transducer array 220 may present audio content via air conduction (e.g., via one or more speakers), via bone conduction (via one or more bone conduction transducer), via cartilage conduction audio system (via one or more cartilage conduction transducers), or some combination thereof. In some embodiments, the transducer array 220 may include one or more transducers to cover different parts of a frequency range. For example, a piezoelectric transducer may be used to cover a first part of a frequency range and a moving coil transducer may be used to cover a second part of a frequency range.

The transducer array 220 provides audio content in accordance with instructions from the audio controller 230. The transducer array 220 may be coupled to the electronic device or some other connected device (e.g., a mobile phone), or some combination thereof.

The audio controller 230 controls operation of the audio system 200. The audio controller 230 performs an interference estimation algorithm on an audio signal as described in further detail below. In the embodiment of FIG. 2, the audio controller 230 includes a data store 235, a sound event detector module 240, a direction of arrival (DOA) estimation module 245, a tracking module 250, a transfer function module 255, a coefficient generation module 260, a sound filter module 265, and a communication module 270. The audio controller 230 may be located inside the electronic device. Some embodiments of the audio controller 230 have different components than those described here. Similarly, functions can be distributed among the components in different manners than described here. For example, some functions of the audio controller 230 may be performed external to the electronic device.

The data store 235 stores data for use by the audio system 200. Data in the data store 235 may include sounds recorded in the local area of the audio system 200, audio signals, frequency bands of audio signals, sound events, DOA estimates, a model of the local area, head-related transfer functions (HRTFs), transfer functions for one or more microphones, array transfer functions (ATFs) for one or more microphones, echo signals, attenuation coefficients, sound filters, interference-suppressed audio signals, time domain audio signals, and other data relevant for use by the audio system 200, or any combination thereof.

The model of the local area tracks the positions and movements for some or all of the sound sources (including the user) in the local area and stores acoustic parameters and a location characteristic that describes the local area. The model of the local area may include positional information about the user (e.g., a location and an orientation of the user in the local area) and movement information about the user (e.g., gestures performed by the user). The model of the local area may also include positional information about the sound sources (e.g., a location of each sound source in the local area) and movement information about the sound sources (e.g., gestures performed by the sound sources). The model of the local area may also include acoustic parameters (e.g., reverberation time) that describe acoustic properties of the local area and a location characteristic (e.g., indoor or outdoor) that describes the local area. In some embodiments, the audio system updates the model of the local area with updated information about the user, updated information about the sound sources, updated information about the local area over time, or some combination thereof.

The interference detector module 240 is configured to determine if any interferences are included in the audio signal based in part on information from the microphone array 210. The interference detector module 240 analyzes the audio signal to determine what types of interferences may be present in the audio signal. For example, the interference detector module 240 may determine a wind interference is present, a nonstationary interference is present (e.g., based on detected voice activity in the audio signal), an echo interference is present (e.g., based on detected double talk in the audio signal), or some combination thereof. For example, the interference detector module 240 may use known techniques to analyze one or more power spectrums of the audio signal, resonance of the audio signal, and/or a pitch of the audio signal to determine if wind interference is present in the audio signal. The interference detector module 240 may determine wind interference is present by extracting one or more features of the audio signal associated with wind interference. In some embodiments, the interference detector module 240 may determine an energy ratio (e.g., a feature of the audio signal) of a low-band audio signal to the audio signal. The interference detector module 240 may apply a low-pass filter (LPF) (e.g., with a cutoff frequency of 100 Hertz (Hz)) to the audio signal to obtain a low-band audio signal. The interference detector module 240 may calculate the energy of the obtained low-band audio signal and the energy of the audio signal. The interference detector module 240 computes the energy ratio between the energy of the low-band audio signal to the energy of the audio signal. The interference detector module 240 may smooth the obtained energy ratio and if the smoothed energy ratio is larger than a threshold (e.g., 0.45) then the interference detector module 240 may determine that wind interference is present in the audio signal.

In some embodiments, the interference detector module 240 may determine a spectral centroid of the audio signal (e.g., another feature of the audio signal). The interference detector module 240 may process the audio signal with a N-point fast Fourier transform (FFT). For example, if a sample rate,fs, of the audio signal is 16 kHz and Nis 256, 2 kHz will take place around the J-th frequency bin, where J=integer of (2000*Nfs). The interference detector module 240 may calculate the spectral centroid,$f_{sc}$, which covers frequencies between 0 Hz (e.g., frequency bin 0) and 2 kHz (e.g., frequency bin J). The interference detector module 240 may smooth the spectral centroid, $f_{sc}$, and if the smoothed spectral centroid is less than a threshold frequency (e.g., 40 Hz), then the interference detector module 240 may determine that wind interference is present in the audio signal.

In some embodiments, the interference detector module 240 may determine a coherence between the microphone signals (e.g., another feature of the audio signal). For example, the interference detector module 240 may determine K coherence values with K M(M−1)/2, where M is the number of microphone signals. Wind interference has low correlation in frequencies lower than 6 kHz. The interference detector module 240 may calculate the coherence between two microphone signals, and if the coherence value is smaller than a threshold coherence value (e.g., 0.25) for frequencies up to 6 kHz then the interference detector module 240 may determine that wind interference is present in the two microphone signals. If more than K/2 coherence values indicate the presence of wind interference, then the interference detector module 240 may determine that wind interference is present in the audio signal. In some embodiments, the above three features (i.e., energy ratio, spectral centroid, and coherence) of the audio signal can further be combined by the interference detector module 240 in a statistically rigorous way to optimally detect the presence of wind interference in the audio signal. For example, if two or three features indicate the presence of wind interference, then the interference detector module 240 may determine wind interference is present in the audio signal. In some embodiments, the related parameters, such as the thresholds, can be pre-determined and tuned by a training dataset.

The interference detector module 240 may update the model of the local area (e.g., a location characteristic of the local area) based on a wind interference being present in the audio signal.

The interference detector module 240 may determine a nonstationary interference is present based on detected voice activity in the audio signal. In some embodiments, the interference detector module 240 may utilize the model of the local area to determine if any sound sources in the local area (including the user) are talking (e.g., based on tracked gestures of the user and the sound sources stored in the model of the local area). In some embodiments, the interference detector module 240 may analyze the audio signal to determine if voice activity is present using one or more known voice activity detection (VAD) techniques. The interference detector module 240 may determine nonstationary interference is present by extracting one or more features of the audio signal associated with nonstationary interference. In some embodiments, the interference detector module 240 may determine a short-time zero-crossing rate (ZCR) (e.g., a feature of the audio signal). For example, the interference detector module 240 may count the number of zero-crossings for the audio signal in a frame and if the number of zero-crossings for the audio signal is smaller than a threshold number of zero-crossings then the interference detector module 240 may determine voice activity (e.g., a nonstationary interference) may be present in the audio signal.

In some embodiments, the interference detector module 240 may determine a periodicity of the audio signal (e.g., another feature of the audio signal). For example, the interference detector module 240 may apply a bandpass filter to the audio signal (e.g., with a pass band of 60 Hz to 2 kHz). The interference detector module 240 may estimate an autocorrelation and determine a peak of the pass-band audio signal. The interference detector module 240 may compare the determined peak with a peak threshold. Based on the comparison, the interference detector module 240 may determine voice activity to be present in the audio signal.

In some embodiments, the interference detector module 240 may determine an energy ratio (e.g., a feature of the audio signal) of a high-band audio signal to the audio signal. For example, the interference detector module 240 may apply a high-pass filter (HPF) (e.g., with a cutoff frequency of 3 kHz) to the audio signal to obtain the high-band audio signal. The interference detector module 240 may calculate the energy of the obtained high-band audio signal and the energy of the audio signal. The interference detector module 240 computes the energy ratio between the energy of the high-band audio signal to the energy of the audio signal. The interference detector module 240 may smooth the obtained energy ratio and if the smoothed energy ratio is less than a threshold then the interference detector module 240 may determine that voice activity is present in the audio signal.

In some embodiments, the interference detector module 240 may determine an audio envelope-to-floor ratio (e.g., another feature of the audio signal). For example, the interference detector module 240 may calculate an absolute value audio signal. The interference detector module 240 may apply a fast-attack and slow-release filter to the absolute value audio signal (e.g., with an attack time of 5 milliseconds (ms) and a release time of 50 ms) to obtain the envelope signal. The interference detector module 240 may apply a slow-attack and fast-release filter (e.g., with an attack time of 1 second and a release time of 100 ms) to the absolute value audio signal to obtain the floor signal. The interference detector module 240 may compute a ratio between the envelope signal to the floor signal (e.g., the envelope-to-floor ratio). The interference detector module 240 may smooth the envelope-to-floor ratio and if the smoothed envelope-to-floor ratio is larger than a threshold than the interference detector module 240 may determine that voice activity is present in the audio signal. In some embodiments, the above four features (i.e., the short-time ZCR, the periodicity, the energy ratio, and the envelope-to-floor ratio) of the audio signal can further be combined by the interference detector module 240 in a statistically rigorous way as described above. In some embodiments, the thresholds, can be pre-determined and tuned by a training dataset.

The interference detector module 240 may determine an echo interference is present based on detected double talk in the audio signal. In some embodiments, the interference detector module 240 may use one or more known double talk detection techniques, such as a Geigel detector, to determine if double talk is present in the audio signal. The interference detector module 240 may determine an echo interference is present by extracting one or more features of the audio signal associated with echo interference. In some embodiments, the interference detector module 240 may determine an echo return loss enhancement (ERLE), a cross-correlation coefficient between the audio signal and a linear echo cancellation output signal, and a cross-correlation coefficient between the audio signal and the estimated echo signal (e.g., all three are features of the audio signal). The interference detector module 240 may compare each feature with a respective threshold value to determine if double talk activity is present in the audio signal. The threshold values may be pre-determined and tuned by a training dataset.

The DOA estimation module 245 is configured to localize sound sources in the local area based in part on information from the microphone array 210. Localization is a process of determining where sound sources are located relative to the user of the audio system 200. The DOA estimation module 245 performs a DOA analysis to localize one or more sound sources within the local area and update the mode of the local area accordingly. The DOA analysis may include analyzing the intensity, spectra, and/or arrival time of each sound at the sensor array 220 to determine the direction from which the sounds originated. In some cases, the DOA analysis may include any suitable algorithm for analyzing a surrounding acoustic environment in which the audio system 200 is located.

For example, the DOA analysis may be designed to receive input signals from the microphone array 210 and apply digital signal processing algorithms to the input signals to estimate a direction of arrival. These algorithms may include, for example, delay and sum algorithms where the input signal is sampled, and the resulting weighted and delayed versions of the sampled signal are averaged together to determine a DOA. A least mean squared (LMS) algorithm may also be implemented to create an adaptive filter. This adaptive filter may then be used to identify differences in signal intensity, for example, or differences in time of arrival. These differences may then be used to estimate the DOA. In another embodiment, the DOA may be determined by converting the input signals into the frequency domain and selecting specific bins within the time-frequency (TF) domain to process. Each selected TF bin may be processed to determine whether that bin includes a portion of the audio spectrum with a direct path audio signal. Those bins having a portion of the direct-path signal may then be analyzed to identify the angle at which the microphone array 210 received the direct-path audio signal. The determined angle may then be used to identify the DOA for the received input signal. Other algorithms not listed above may also be used alone or in combination with the above algorithms to determine DOA.

In some embodiments, the DOA estimation module 245 may also determine the DOA with respect to an absolute position of the audio system 200 within the local area. The position of the microphone array 210 may be received from an external system (e.g., some other component of a headset, an artificial reality console, a mapping server, a position sensor (e.g., the position sensor 190), etc.). The external system may create a virtual model of the local area, in which the local area and the position of the audio system 200 are mapped. The received position information may include a location and/or an orientation of some or all of the audio system 200 (e.g., of the microphone array 210). The DOA estimation module 245 may update the estimated DOA based on the received position information.

The tracking module 250 is configured to track locations of one or more sound sources. The tracking module 250 may compare current DOA estimates and compare them with a stored history of previous DOA estimates. In some embodiments, the audio system 200 may recalculate DOA estimates on a periodic schedule, such as once per second, or once per millisecond. The tracking module may compare the current DOA estimates with previous DOA estimates, and in response to a change in a DOA estimate for a sound source, the tracking module 250 may determine that the sound source moved. In some embodiments, the tracking module 250 may detect a change in location based on visual information received from the headset or some other external source. The tracking module 250 may track the movement of one or more sound sources over time. The tracking module 250 may store values for a number of sound sources and a location of each sound source at each point in time in the model of the local area. In response to a change in a value of the number or locations of the sound sources, the tracking module 250 may determine that a sound source moved, and the model of the local area is updated accordingly. The tracking module 250 may calculate an estimate of the localization variance. The localization variance may be used as a confidence level for each determination of a change in movement.

The transfer function module 255 is configured to generate one or more acoustic transfer functions. Generally, a transfer function is a mathematical function giving a corresponding output value for each possible input value. Based on parameters of the detected sounds, the transfer function module 255 generates one or more acoustic transfer functions associated with the audio system. The acoustic transfer functions may be array transfer functions (ATFs), head-related transfer functions (HRTFs), other types of acoustic transfer functions, or some combination thereof. An ATF characterizes how the microphone (e.g., a microphone of the microphone array 210) receives a sound from a point in space.

An ATF includes a number of transfer functions that characterize a relationship between the sound sounds and the corresponding sound received by the acoustic sensors in the microphone array 210. Accordingly, for a sound source there is a corresponding transfer function for each of the acoustic sensors in the microphone array 210. And collectively the set of transfer functions is referred to as an ATF. Accordingly, for each sound source there is a corresponding ATF. Note that the sound source may be, e.g., someone or something generating sound in the local area, the user, or one or more transducers of the transducer array 220. The ATF for a particular sound source location relative to the microphone array 210 may differ from user to user due to a person's anatomy (e.g., ear shape, shoulders, etc.) that affects the sound as it travels to the person's ears. Accordingly, the ATFs of the microphone array 210 are personalized for each user of the audio system 200.

In some embodiments, the transfer function module 255 determines one or more HRTFs for a user of the audio system 200. The HRTF characterizes how an ear receives a sound from a point in space. The HRTF for a particular source location relative to a person is unique to each ear of the person (and is unique to the person) due to the person's anatomy (e.g., ear shape, shoulders, etc.) that affects the sound as it travels to the person's ears. In some embodiments, the transfer function module 255 may determine HRTFs for the user using a calibration process. In some embodiments, the transfer function module 255 may provide information about the user to a remote system. The remote system determines a set of HRTFs that are customized to the user using, e.g., machine learning, and provides the customized set of HRTFs to the audio system 200.

The coefficient generation module 260 is configured to apply an interference estimation algorithm to the audio signal to generate an attenuation coefficient for each of the plurality of interferences. The coefficient generation module 260 receives the microphone signals from the microphone array 210. In some embodiments, the coefficient generation module 260 performs one or more pre-processing operations during the application of the interference estimation algorithm. For example, the coefficient generation module 260 may apply a pre-amplifier to the microphone signals and a reconfigurable HPF to the audio signal. The pre-amplifier may amplify the microphone signals prior to the microphone signals being combined into the audio signal (e.g., because the microphone signals may be too weak for further processing). The reconfigurable HPF minimizes low frequency interferences present in the received audio signal and ensures that the audio signal has zero mean. The coefficient generation module 260 may reconfigure the HPF depending on the audio application. For example, the coefficient generation module 260 may use an HPF with a cutoff frequency of approximately 80 Hertz (Hz) for voice-trigger, ASR, and wideband frequency voice communication or VoIP applications. In another example, the coefficient generation module 260 may use an HPF with a cutoff frequency of approximately 150 Hz for narrowband voice communication or VoIP applications. In some embodiments, the coefficient generation module 260 may implement an HPF with a second order infinite impulse response filter.

The coefficient generation module 260 may perform an additional pre-processing operation that includes providing the audio signal to an analysis filter bank. The analysis filter bank may be an array of band-pass filters. The analysis filter bank separates the audio signal into multiple components, each one including a single frequency sub-band of the original audio signal. For example, the coefficient generation module 260 may provide the audio signal to an analysis filter bank that divides the audio signal into M-band audio signals $x_1(n), x_2(n), \ldots, x_M(n)$. In one example, M=32. Each band of the audio signal may correspond to a different portion of the frequency spectrum of the audio signal. The analysis filter bank may include various approaches to divide the audio signal into the M-band audio signals, such as FFT filter banks (e.g., weighted overlap add (WOLA)), time-frequency distribution filter banks (e.g., spectrograms), or multi-rate filter banks (e.g., discrete Fourier transform-based uniform filter banks).

The coefficient generation module 260 may perform an additional pre-processing operation that includes estimating an echo signal (e.g., a linear portion of an echo signal) included in the audio signal. In some embodiments, the coefficient generation module 260 estimates an echo signal included in each of the M-band audio signals. In some embodiments, to estimate the echo signal, the coefficient generation module 260 records the audio signal and applies an adaptive filter to the recorded audio signal. An output of the adaptive filter is an estimated linear portion of the echo signal. The coefficient generation module 260 reduces the linear portion of the echo signal included in the audio signal by subtracting the linear portion of the echo signal from the audio signal. In some embodiments, when the interference detector module 240 detects double talk in the audio signal, the coefficient generation module 260 may apply an adaptive filter that is unchanging (e.g., the adaptive filter coefficient values remain constant during current and subsequent pre-processing operations when double talk is detected). In some embodiments, the coefficient generation module 260 may determine that an echo path change takes place based on the model of the local area. For example, the user may perform a particular gesture (e.g., tap a display of the electronic device, press a button on the electronic device, voice a command, or some other suitable gesture indicating a change in the echo path has taken place) that is stored in the model of the local area. When the echo path change is detected by the coefficient generation module 260 and double talk is detected by the interference detector module 240, the coefficient generation module 260 applies an adaptive filter that is changing, and the linear portion of the echo signal is subtracted from the audio signal.

The coefficient generation module 260 may perform an additional pre-processing operation which includes separating the audio signal (or each of the M-band audio signals) into two separate signals (e.g., a first separate audio signal and a second separate audio signal) according to direction of arrival estimates determined by the DOA estimation module 245 and the model of the local area. For example, the coefficient generation module 260 determines a particular sound (e.g., speech emitted by the user) and near-by interferences are separated from the audio signal into the first separate audio signal. A near-by interference is any interference emitted by a sound source (not the user) that is located within a threshold distance of the user. The coefficient generation module 260 determines all other interferences (e.g., interferences emitted by various sound sources located beyond a threshold distance of the user) are separated from the audio signal into the second separate audio signal. A signal-to-noise ratio (SNR) for the first separate audio signal is improved with the separation.

The coefficient generation module 260 generates an attenuation coefficient for each of the plurality of interferences (e.g., of different types). In some embodiments, the coefficient generation module 260 generates an attenuation coefficient for each of the plurality of interferences based on the location characteristic of the local area stored in the model of the local area. For example, if the local area has a location characteristic of being indoor, the coefficient generation module 260 does not determine an attenuation coefficient for a wind interference and may determine an attenuation coefficient for other interferences. In some embodiments, the coefficient generation module 260 generates an attenuation coefficient based on the end user. For example, if the end user is an electronic device (e.g., a machine listener) the coefficient generation module 260 does not determine an attenuation coefficient for an echo interference and may determine an attenuation coefficient for other interferences.

The coefficient generation module 260 may generate an attenuation coefficient for wind interference. In some embodiments, the coefficient generation module 260 may determine a wind root-mean-square (RMS) spectrum up to a threshold frequency, $f_{limit}$, of the first separate audio signal. The threshold frequency, $f_{limit}$, is dependent upon the audio application. For example, for voice-trigger and/or ASR applications the threshold frequency is 2 kHz, for narrowband VoIP the threshold frequency is 3.4 kHz, and wideband VoIP the threshold frequency is 7 kHz. The coefficient generation module 260 may smooth the determined wind RMS spectrum by applying a smoothing function:

$$W(m,k)=W(m-1,k)+\alpha*(W'(m,k)-W(m-1,k)) \quad (1)$$

where W(m,k) is the smoothed wind RMS spectrum, W'(m, k) is the estimated wind RMS spectrum at the k-th frequency band (k=0, 1, . . . , M−1) and in the m-th frame, and parameter a is a smoothing factor and ranges in value from 0.0 to 1.0. The coefficient generation module 260 estimates the attenuation coefficient for wind interference by applying the following equation:

$$G'(m,k)=\sqrt{1-\mu(k)\frac{|W(m,k)|^2}{|Y(m,k)|^2}} \quad (2)$$

where G'(m,k) is the estimated attenuation coefficient at the k-th frequency band (k=0, 1, . . . M−1) and in the m-th frame, Y(m,k) is a subband RMS spectrum of the first separate audio signal at the k-th frequency band and in the m-th frame, μ(k) is a parameter and ranges in value from 0.0 to 1.3. The attenuation coefficient satisfies the following equation:

$$\text{maxSuppression}(k) \leq G'(m,k) \leq 1 \leq \tag{3}$$

where maxSuppression(k) is reconfigurable according to the audio application. For example, the maxSuppression(k) may be 0.5 for voice-trigger and/or ASR applications and approximately 1.2 for VoIP applications. The coefficient generation module 260 may smooth the attenuation coefficient using the following equation:

$$G(m,k)=G(m-1,k)+\beta(3(m,k)*(G'(m,k)-G(m-1,k)) \tag{4}$$

where G(m,k) is the smoothed attenuation coefficient, β(m, k) is a time frequency dependent smoothing factor and ranges in value from 0.0 to 1.0

The coefficient generation module 260 may generate an attenuation coefficient for stationary interference. In some embodiments, the coefficient generation module 260 may determine a stationary interference RMS spectrum of the first separate audio signal for each of the M-band audio signals over a sliding time window (e.g., a length of 2 seconds). The coefficient generation module 260 may smooth the determined stationary interference RMS spectrum by applying Equation 1. The coefficient generation module 260 estimates the attenuation coefficient for stationary interference by applying Equation 2 to the smoothed stationary interference RMS spectrum. The coefficient generation module 260 may smooth the attenuation coefficient for stationary interference using Equation 4.

The coefficient generation module 260 may generate an attenuation coefficient for reverberation interference. In some embodiments, the coefficient generation module 260 may determine this attenuation coefficient by determining a reverberant RMS spectrum of the first separate audio signal. In some embodiments, the reverberation time (e.g., RT60) is determined based on acoustic parameters stored in the model of the local area. The coefficient generation module 260 may smooth the reverberant RMS spectrum by applying Equation 1. The coefficient generation module 260 estimates the attenuation coefficient for reverberation interference by applying Equation 2 to the smoothed reverberant RMS spectrum. The coefficient generation module 260 may smooth the attenuation coefficient for reverberation interference using Equation 4.

The coefficient generation module 260 may generate an attenuation coefficient for a residual echo interference (e.g., including a nonlinear portion of an echo signal included in the audio signal). The coefficient generation module 260 may determine this attenuation coefficient by determining a residual echo RMS spectrum of the second separate audio signal. In some embodiments, a residual echo RMS spectrum is determined based in part on the estimated echo signal determined during a pre-processing operation as described above. The coefficient generation module 260 may smooth the residual echo RMS spectrum by applying Equation 1. The coefficient generation module 260 estimates the attenuation coefficient for residual echo interference by applying Equation 2 to the smoothed residual echo RMS spectrum. The coefficient generation module 260 may smooth the attenuation coefficient for residual echo interference using Equation 4.

The coefficient generation module 260 may generate an attenuation coefficient for nonstationary interference. In some embodiments, the coefficient generation module 260 may determine this attenuation coefficient by determining a nonstationary interference RMS spectrum of the second separate audio signal. The coefficient generation module 260 may smooth the nonstationary interference RMS spectrum by applying Equation 1. The coefficient generation module 260 estimates the attenuation coefficient for nonstationary interference by applying Equation 2 to the smoothed nonstationary interference RMS spectrum. The coefficient generation module 260 may smooth the attenuation coefficient for nonstationary interference using Equation 4.

The sound filter module 265 is configured to suppress the plurality of interferences from the audio signal by using the generated attenuation coefficients from the coefficient generation module 260. The sound filter module 265 may multiply the attenuation coefficients for a band (e.g., k=1) determined by the coefficient generation module 260 together to determine a combined attenuation coefficient for that band. The sound filter module 265 may repeat this process for each band. The sound filter module 265 may smooth the combined attenuation coefficient for each band using Equation 4.

The sound filter module 265 may convert from M combined attenuation coefficients to N/2 attenuation coefficients that apply to N/2 bins of the audio signal. In some embodiments, the sound filter module 265 increases a count of the M combined attenuation coefficients by using linear interpolation to match the N/2 bins to determine a final attenuation coefficient for each bin (e.g., because M is normally less than N/2). In some embodiments, the sound filter module 265 increases the count of combined attenuation coefficients by using a band gain for each bin inside that band.

The sound filter module 265 may suppress the plurality of interferences from the audio signal by multiplying the final attenuation coefficient with the audio signal by the following equation:

$$|X(m,i)|^2=P(m,i)*|Y(m,i)|;|X(m,0)|=0 \tag{5}$$

where P(m,i) is the final attenuation coefficient, Y'(m,i) is a magnitude spectrum of the audio signal at the i-th bin (i=1, 2, . . . , N/2 where N is the FFT length) and in the m-th frame, and X(m,i) is a magnitude spectrum of the interference-suppressed audio signal.

The sound filter module 265 may transform the interference-suppressed audio signal from the frequency domain to a time domain audio signal. In some embodiments, the sound filter module 265 applies a synthesis filter bank to the interference-suppressed audio signal to construct a time domain audio signal that is interference-suppressed.

In some embodiments, the sound filter module 265 may apply one or more filters to the audio signal that cause the audio signal to be spatialized, such that when the audio signal is presented to an end user (e.g., a user of a headset), the audio content appears to originate from a target region. In some embodiments, the sound filter module 265 may use HRTFs and/or acoustic parameters to generate the one or more sound filters. In some embodiments, the sound filter module 265 may apply an additional one or more filters to the audio signal that may cause positive or negative amplification of sounds as a function of frequency.

The communication module 270 communicates with one or more external systems communicatively coupled to the audio system 200. The communication module 270 may include a receiver (e.g., an antennae) and a transmitter. The external systems may include, e.g., some other component of the electronic device (e.g., a DCA or a PCA), a console, an I/O interface, a mapping server, etc. The communication module 270 may send and receive data related to the model of the local area with the mapping server.

The processing and computations performed by the audio controller 230 allows for significant reduction in computational complexity of suppressing the plurality of interferences in an audio signal. For example, the audio controller 230 suppresses the interferences (e.g., of different types) simultaneously. The audio controller 230 can be configured to support various applications (e.g., VoIP, ASR, and voice-trigger). The audio controller 230 requires less memory and less processing time during the suppression of interferences in the audio signal. The audio controller 230 globally optimizes speech performance (e.g., speech quality and understandability) due to the parallel (joint) suppression of sounds in an audio signal associated with interferences of different types.

Figure 3A:
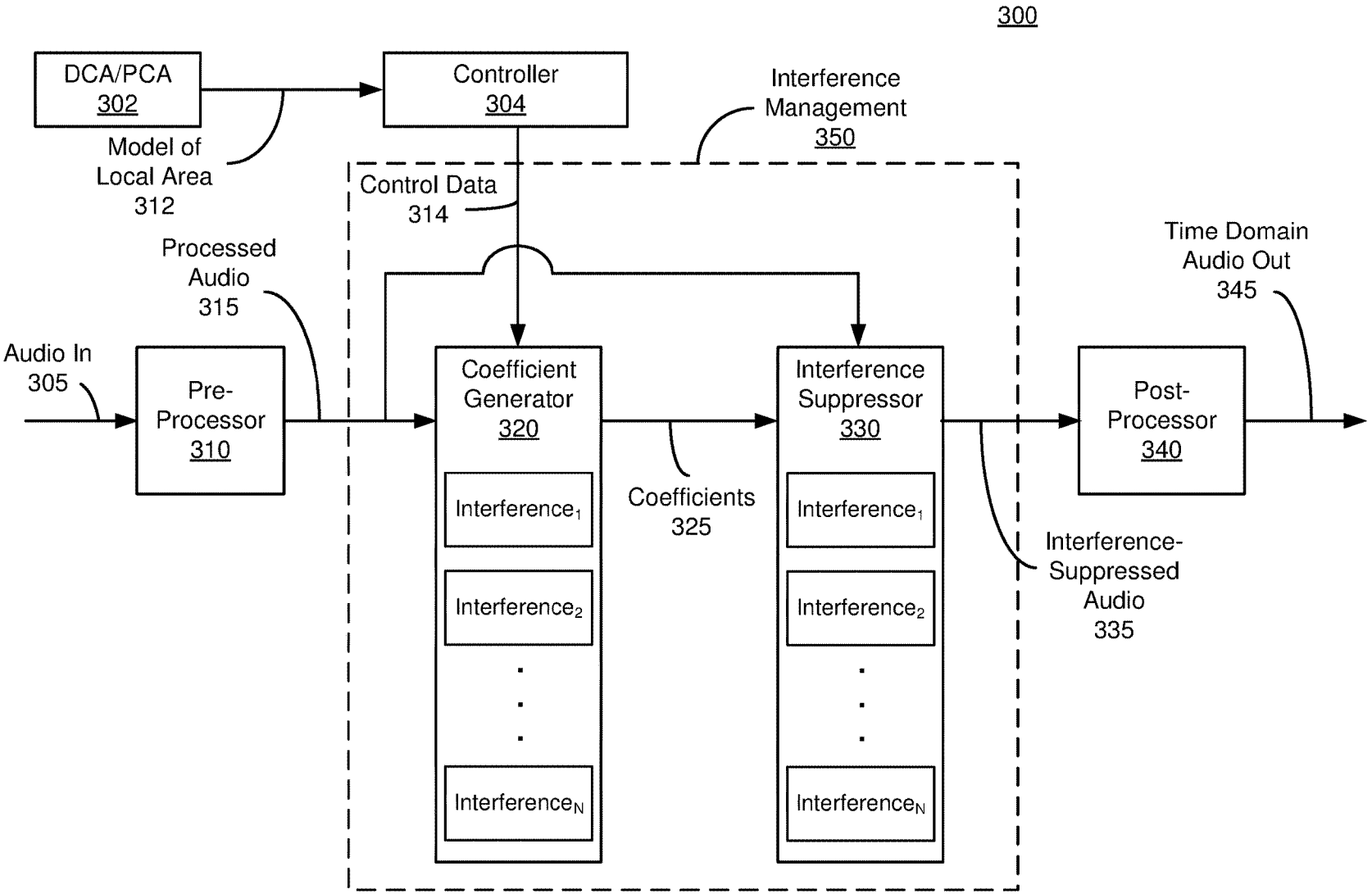
FIG. 3A is a block diagram illustrating data flow for an interference management system, in accordance with one or more embodiments.

FIG. 3A is a block diagram illustrating data flow 300 for an interference management system 350, in accordance with one or more embodiments. In an example embodiment, a pre-processor 310, a controller 304, the interference management system 350, and a post-processor 340 may be included in an audio system (e.g., the audio system 200) integrated on an electronic device. An input audio signal (e.g., audio in 305) is provided by one or more microphones (e.g., the microphone array 210) to a pre-processor 310. The audio in 305 may include a plurality of interferences (e.g., $\text{interference}_1$, $\text{interference}_2$, . . . , $\text{interference}_N$). The interferences may negatively affect the understandability of the audio signal for an end user (e.g., a human listener or a machine listener). Each interference may be of a different type. The types of interferences may include, e.g., a wind interference, a reverberation interference, an echo interference, a stationary interference, and/or a nonstationary interference). The pre-processor 310 may perform one or more pre-processing operations on the audio in 305. For example, the pre-processor 310 may divide the audio in 305 signal into M frequency bands. In another example, the pre-processor 310 may separate the audio in 305 (or the M-bands of audio in 305 each) into two audio signals. The pre-processor 310 provides any processed audio 315 to the interference management system 350.

The interference management system 350 is configured to generate an attenuation coefficient 325 for each of the plurality of interferences present in the processed audio 315 and to suppress the interferences by applying the attenuation coefficients 325 to the processed audio 315. The interference management system 350 may receive control data 314 from a controller 304. The controller 304 may receive a model of the local area 312 from a depth camera assembly (DCA) and/or passive camera assembly (PCA) 302 integrated on the electronic device or communicatively coupled to the electronic device. The model of the local area 312 may include position and movement information about one or more sound sources in the local area. The controller 304 utilizes the model of the local area 312 and provides control data 314 to a coefficient generation 320. For example, the control data 314 may instruct the coefficient generator 320 to only generate an attenuation coefficient for a subset of interferences (e.g., a reverberation interference, a residual echo interference, a stationary interference, and/or a non-stationary interference).

The coefficient generator 320 generates coefficients 325 for each interference simultaneously and provides the coefficients 325 to an interference suppressor 330. The processed audio 315 is received by the interference suppressor 330 and the interference suppressor 330 applies the coefficients 325 to the processed audio 315 to suppress the plurality of interferences in the processed audio 315. The interference suppressor 330 applies the coefficients 325 to the processed audio 315 simultaneously to determine an interference-suppressed audio signal 335 that is provided to the post-processor 340.

The post-processor 340 may apply one or more additional filters to the interference-suppressed audio signal 335 prior to presenting the signal to an end user. For example, the post-processor may apply a filter to the interference-suppressed audio signal 335 to enhance certain frequencies. The post-processor 340 determines a time domain audio output 345 and provides the time domain audio output 345 to the end user (e.g., user of a headset device or the electronic device). The post-processor 340 determines the time domain audio output 345 by transforming the interference-suppressed audio signal 335 from the frequency domain to the time domain.

In an example, the audio in 305 includes at least two different interferences (e.g., $\text{interference}_1$ and $\text{interference}_2$). The interference management system 350 generates an attenuation coefficient 325 for $\text{interference}_1$ and for $\text{interference}_2$ present in the processed audio 315 and suppresses $\text{interference}_1$ and $\text{interference}_2$ by applying the attenuation coefficients 325 to the processed audio 315. The generation of each attenuation coefficient 325 is performed jointly (or simultaneously) by the coefficient generator 320. The suppression of each interference by applying the attenuation coefficients 325 is performed jointly (or simultaneously) by the interference suppressor 330.

Figure 3B:
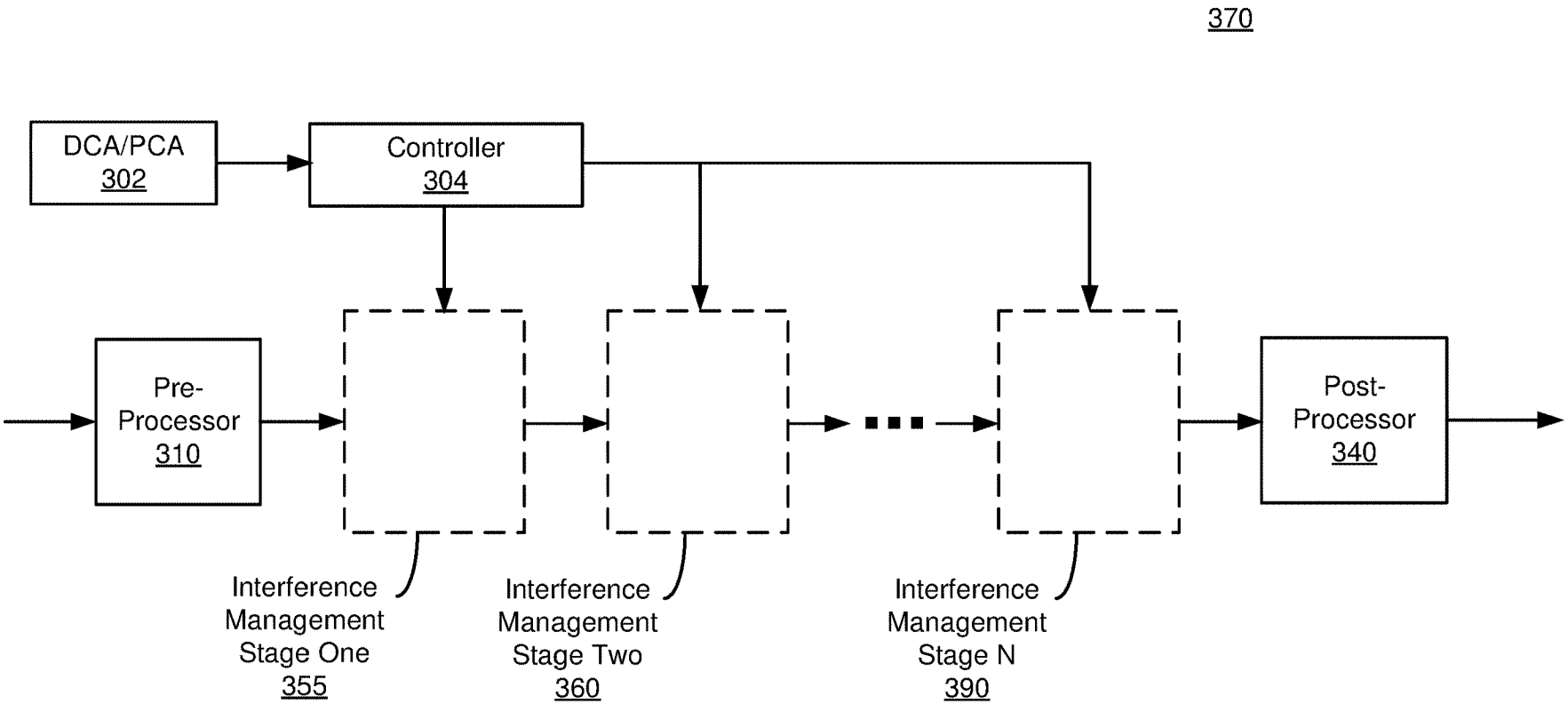
FIG. 3B is a block diagram illustrating data flow for an interference management system in a cascaded configuration, in accordance with one or more embodiments.

FIG. 3B is a block diagram illustrating data flow 370 for an interference management system in a cascaded configuration, in accordance with one or more embodiments. The data flow 370 is substantially similar to the data flow 300 described in FIG. 3A. The interference management system in the cascaded configuration may include more than one stage (e.g., stage one, stage two, . . . , stage N) of interference management systems (e.g., interference management system stages 355, 360, 390). Each stage is substantially similar to the interference management system 350 of FIG. 3A. For example, each stage may suppress the same interferences present in the audio signal audio in 305. If the audio in 305 includes at least two different interferences (e.g., $\text{interference}_1$ and $\text{interference}_2$), the interference management system stages 355, 360, 390 generate an attenuation coefficient 325 for $\text{interference}_1$ and for $\text{interference}_2$ and suppress $\text{interference}_1$ and $\text{interference}_2$ by applying the attenuation coefficients 325 to the processed audio 315. In another example, each stage may apply a same amount of interference suppression. If a particular audio application performs best with 30 decibels (dB) interference suppression and the cascaded configuration includes three stages of interference management systems, each interference management system stage suppresses 10 dB of interferences.

In some embodiments, the stages may differ in an amount of interference suppression applied by the audio system. For example, each stage applies less suppression than the previous stage. For example, the interference management system stage 355 may apply a greater amount of interference suppression than interference management stage 360. In another example, depending on the audio application, if a cascaded configuration includes three stages of interference management systems, a first and second stage may suppress 10 dB of interferences and a third stage may be bypassed.

An interference management system in a cascaded configuration may achieve a greater signal-to-interference ratio (SIR) improvement (e.g., by improving speech quality and understandability) than a single stage interference management system (e.g., as illustrated in FIG. 3A). For example, when the audio signal audio in 305 has a low SIR, obtaining accurate interference estimation and suppression is difficult using a single-stage. With a cascaded configuration, part of the interference suppression takes place in the first stage improving the SIR and allowing the second stage to obtain even more accurate interference estimation and suppression than the first stage. Thus, with each succeeding stage, the accuracy of the interference estimation and suppression is increased further improving the SIR of the audio signal.

Figure 4:
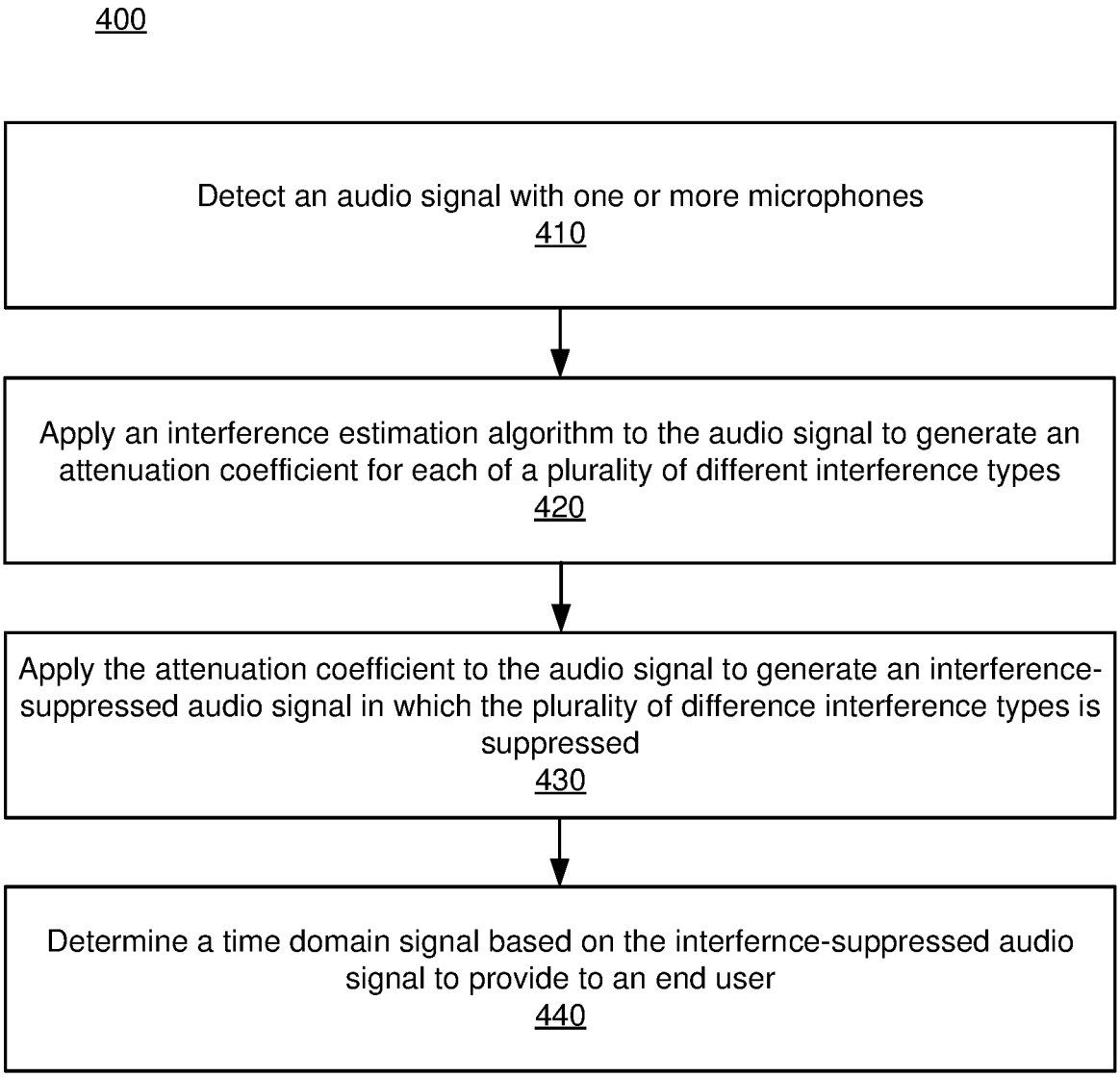
FIG. 4 is a flowchart illustrating a process for interference suppression of an audio signal, in accordance with one or more embodiments.

FIG. 4 is a flowchart illustrating a process for interference suppression of an audio signal, in accordance with one or more embodiments. The process shown in FIG. 4 may be performed by components of an audio system (e.g., audio system 200) integrated on an electronic device (e.g., a headset, a laptop, a digital assistant, etc.). Other entities may perform some or all of the steps in FIG. 4 in other embodiments. Embodiments may include different and/or additional steps, or performance of the steps in different orders.

The audio system detects 410 an audio signal with one or more microphones. The audio signal may include sounds of a plurality of interferences of different types. The different types of interferences may include a wind interference, an echo interference, a reverberation interference, a stationary interference, and a nonstationary interference. Sounds corresponding to any of the interferences are sounds that may cause negative effects to an end user's understanding of the audio signal and in particular to the end user's understanding of sounds emitted by one or more sound sources of interest (including a user of the audio system). In some embodiments, the end user is the same as the user of the electronic device. For example, a user of a headset device is the end user. In some embodiments, the end user is the electronic device (e.g., a machine listener).

The audio system applies 420 an interference estimation algorithm to the audio signal to generate an attenuation coefficient for each of the plurality of interferences. In some embodiments, the audio system performs one or more preprocessing operations on the audio signal during application of the interference estimation algorithm. For example, the audio system may divide the audio signal into a plurality of different frequency bands. In another example, the audio system may separate the audio signal into two separate audio signals (e.g., a first separate audio signal and a second separate audio signal). The audio system generates an attenuation coefficient for each of the plurality of interferences jointly. For example, an attenuation coefficient for a wind interference is determined simultaneously as an attenuation coefficient for a stationary interference. In some embodiments, to generate an attenuation coefficient for each of the plurality of interferences, the audio system may determine a RMS spectrum for each interference, smooth each RMS spectrum by applying Equation 1, estimate the attenuation coefficient for each interference by applying Equation 2 to the smoothed RMS spectrum, and smooth the attenuation coefficient for each interference using Equation 4 as described above.

The audio system applies 430 the attenuation coefficients to the audio signal to generate an interference-suppressed audio signal in which the plurality of interferences is suppressed. In some embodiments, the audio system may multiply the attenuation coefficients for a band (e.g., k=1) together to determine a combined attenuation coefficient for that band and repeat this process for each band. The audio system may smooth the combined attenuation coefficient for each band using Equation 4 as described above. In some embodiments, the audio system may convert from M combined attenuation coefficients to N/2 attenuation coefficients that apply to N/2 bins of the audio signal. Each N/2 attenuation coefficient is a final attenuation coefficient for that bin. The audio system may suppress the plurality of interferences from the audio signal by multiplying the final attenuation coefficient with the audio signal using Equation 5.

The audio system determines a time domain signal based on the interference-suppressed audio signal to provide to the end user. In some embodiments, the audio system may transform the interference-suppressed audio signal from the frequency domain to a time domain audio signal by applying a synthesis filter bank to the interference-suppressed audio signal to construct the time domain audio signal that is interference-suppressed.

The process for interference suppression of an audio signal described herein allows for significant reduction in computational complexity of suppressing the plurality of interferences of different types in an audio signal. For example, the audio system suppresses the interferences simultaneously. Additionally, the audio system requires less memory and processing times. The interference-suppressed audio signal (e.g., the output of the audio system) provides a higher-quality listener experience (e.g., optimized for speech enhancement) for a multitude of different audio applications.

Figure 5:
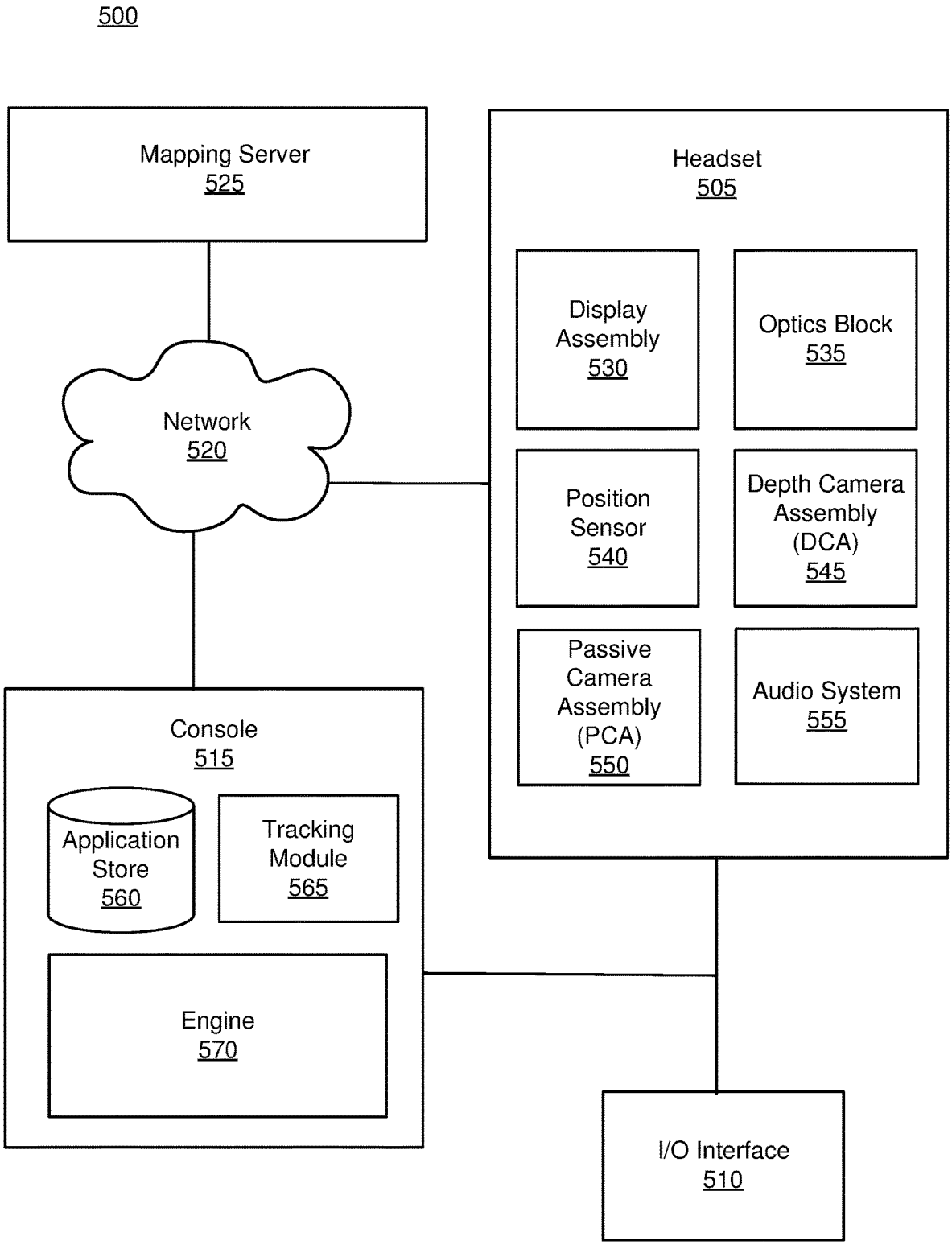
FIG. 5 is a system that includes a headset, in accordance with one or more embodiments.

FIG. 5 is a system 500 that includes a headset 505, in accordance with one or more embodiments. In some embodiments, the headset 505 may be the headset 100 of FIG. 1A or the headset 105 of FIG. 1B. The system 500 may operate in an artificial reality environment (e.g., a virtual reality environment, an augmented reality environment, a mixed reality environment, or some combination thereof). The system 500 shown by FIG. 5 includes the headset 505, an input/output (I/O) interface 510 that is coupled to a console 515, the network 520, and the mapping server 525. While FIG. 5 shows an example system 500 including one headset 505 and one I/O interface 510, in other embodiments any number of these components may be included in the system 500. For example, there may be multiple headsets each having an associated I/O interface 510, with each headset and I/O interface 510 communicating with the console 515. In alternative configurations, different and/or additional components may be included in the system 500. Additionally, functionality described in conjunction with one or more of the components shown in FIG. 5 may be distributed among the components in a different manner than described in conjunction with FIG. 5 in some embodiments. For example, some or all of the functionality of the console 515 may be provided by the headset 505.

The headset 505 includes the display assembly 530, an optics block 535, one or more position sensors 540, a depth camera assembly (DCA) 545, a passive camera assembly (PCA) 550, and an audio system 555. Some embodiments of headset 505 have different components than those described in conjunction with FIG. 5. Additionally, the functionality provided by various components described in conjunction with FIG. 5 may be differently distributed among the components of the headset 505 in other embodiments or be captured in separate assemblies remote from the headset 505.

The display assembly 530 displays content to the user in accordance with data received from the console 515. The display assembly 530 displays the content using one or more display elements (e.g., the display elements 120). A display element may be, e.g., an electronic display. In various embodiments, the display assembly 530 comprises a single display element or multiple display elements (e.g., a display for each eye of a user). Examples of an electronic display include: a liquid crystal display (LCD), an organic light emitting diode (OLED) display, an active-matrix organic light-emitting diode display (AMOLED), a waveguide display, some other display, or some combination thereof. Note in some embodiments, the display element 120 may also include some or all of the functionality of the optics block 535.

The optics block 535 may magnify image light received from the electronic display, corrects optical errors associated with the image light, and presents the corrected image light to one or both eyeboxes of the headset 505. In various embodiments, the optics block 535 includes one or more optical elements. Example optical elements included in the optics block 535 include: an aperture, a Fresnel lens, a convex lens, a concave lens, a filter, a reflecting surface, or any other suitable optical element that affects image light. Moreover, the optics block 535 may include combinations of different optical elements. In some embodiments, one or more of the optical elements in the optics block 535 may have one or more coatings, such as partially reflective or anti-reflective coatings.

Magnification and focusing of the image light by the optics block 535 allows the electronic display to be physically smaller, weigh less, and consume less power than larger displays. Additionally, magnification may increase the field of view of the content presented by the electronic display. For example, the field of view of the displayed content is such that the displayed content is presented using almost all (e.g., approximately 110 degrees diagonal), and in some cases all, of the user's field of view. Additionally, in some embodiments, the amount of magnification may be adjusted by adding or removing optical elements.

In some embodiments, the optics block 535 may be designed to correct one or more types of optical error. Examples of optical error include barrel or pincushion distortion, longitudinal chromatic aberrations, or transverse chromatic aberrations. Other types of optical errors may further include spherical aberrations, chromatic aberrations, or errors due to the lens field curvature, astigmatisms, or any other type of optical error. In some embodiments, content provided to the electronic display for display is pre-distorted, and the optics block 535 corrects the distortion when it receives image light from the electronic display generated based on the content.

The position sensor 540 is an electronic device that generates data indicating a position of the headset 505. The position sensor 540 generates one or more measurement signals in response to motion of the headset 505. The position sensor 190 is an embodiment of the position sensor 540. Examples of a position sensor 540 include: one or more IMUs, one or more accelerometers, one or more gyroscopes, one or more magnetometers, another suitable type of sensor that detects motion, or some combination thereof. The position sensor 540 may include multiple accelerometers to measure translational motion (forward/back, up/down, left/right) and multiple gyroscopes to measure rotational motion (e.g., pitch, yaw, roll). In some embodiments, an IMU rapidly samples the measurement signals and calculates the estimated position of the headset 505 from the sampled data. For example, the IMU integrates the measurement signals received from the accelerometers over time to estimate a velocity vector and integrates the velocity vector over time to determine an estimated position of a reference point on the headset 505. The reference point is a point that may be used to describe the position of the headset 505. While the reference point may generally be defined as a point in space, however, in practice the reference point is defined as a point within the headset 505.

The DCA 545 generates depth information for a portion of the local area. The DCA includes one or more imaging devices and a DCA controller. The DCA 545 may also include an illuminator. Operation and structure of the DCA 545 is described above with regard to FIG. 1A.

The PCA 550 generates color image data for the local area. The PCA may include one or more imaging devices that capture images of some or all of the local area. In some embodiments, the PCA 550 may capture images of one or more sound sources (including the user) in the local area. Further description about the operation and structure of the PCA 550 is described above with regard to FIG. 1A.

The audio system 555 suppresses a plurality of interferences (e.g., of different types) in an audio signal. The audio system 555 is substantially the same as the audio system 200 described above. The audio system 555 may comprise one or more microphones, one or more transducers, and an audio controller. The audio system 555 may detect an audio signal with the one or more microphones. The audio system 555 may apply an interference estimation algorithm to the audio signal to generate an attenuation coefficient for each of the plurality of interferences. The audio system 555 applies the attenuation coefficients to the audio signal to generate the interference-suppressed audio signal in which the plurality of interferences is suppressed. The audio system 555 may determine time domain signal based on the interference-suppressed audio signal to provide to an end user. In some embodiments, the end user is a user of the headset 505 and the time domain signal may be presented by the headset 505 via the one or more transducers as audio content. In some embodiments, the audio system 555 may request acoustic parameters from the mapping server 525 over the network 520. The acoustic parameters describe one or more acoustic properties (e.g., room impulse response, a reverberation time, a reverberation level, etc.) of the local area. The audio system 550 may receive information describing at least a portion of the local area from e.g., the DCA 545, the PCA 550, and/or location information for the headset 505 from the position sensor 540.

The I/O interface 510 is a device that allows a user to send action requests and receive responses from the console 515. An action request is a request to perform a particular action. For example, an action request may be an instruction to start or end capture of image or video data, or an instruction to perform a particular action within an application. The I/O interface 510 may include one or more input devices. Example input devices include: a keyboard, a mouse, a game controller, or any other suitable device for receiving action requests and communicating the action requests to the console 515. An action request received by the I/O interface 510 is communicated to the console 515, which performs an action corresponding to the action request. In some embodiments, the I/O interface 510 includes an IMU that captures calibration data indicating an estimated position of the I/O interface 510 relative to an initial position of the I/O interface 510. In some embodiments, the I/O interface 510 may provide haptic feedback to the user in accordance with instructions received from the console 515. For example, haptic feedback is provided when an action request is received, or the console 515 communicates instructions to the I/O interface 510 causing the I/O interface 510 to generate haptic feedback when the console 515 performs an action.

The console 515 provides content to the headset 505 for processing in accordance with information received from one or more of: the DCA 545, the headset 505, and the I/O interface 510. In the example shown in FIG. 5, the console 515 includes an application store 555, a tracking module 560, and an engine 565. Some embodiments of the console 515 have different modules or components than those described in conjunction with FIG. 5. Similarly, the functions further described below may be distributed among components of the console 515 in a different manner than described in conjunction with FIG. 5. In some embodiments, the functionality discussed herein with respect to the console 515 may be implemented in the headset 505, or a remote system.

The application store 555 stores one or more applications for execution by the console 515. An application is a group of instructions, that when executed by a processor, generates content for presentation to the user. Content generated by an application may be in response to inputs received from the user via movement of the headset 505 or the I/O interface 510. Examples of applications include: gaming applications, conferencing applications, video playback applications, or other suitable applications.

The tracking module 560 tracks movements of the headset 505 or of the I/O interface 510 using information from the DCA 545, the one or more position sensors 540, or some combination thereof. For example, the tracking module 560 determines a position of a reference point of the headset 505 in a mapping of a local area based on information from the headset 505. The tracking module 560 may also determine positions of an object or virtual object. Additionally, in some embodiments, the tracking module 560 may use portions of data indicating a position of the headset 505 from the position sensor 540 as well as representations of the local area from the DCA 545 to predict a future location of the headset 505. The tracking module 560 provides the estimated or predicted future position of the headset 505 or the I/O interface 510 to the engine 565.

The engine 565 executes applications and receives position information, acceleration information, velocity information, predicted future positions, or some combination thereof, of the headset 505 from the tracking module 560. Based on the received information, the engine 565 determines content to provide to the headset 505 for presentation to the user. For example, if the received information indicates that the user has looked to the left, the engine 565 generates content for the headset 505 that mirrors the user's movement in a virtual local area or in a local area augmenting the local area with additional content. Additionally, the engine 565 performs an action within an application executing on the console 515 in response to an action request received from the I/O interface 510 and provides feedback to the user that the action was performed. The provided feedback may be visual or audible feedback via the headset 505 or haptic feedback via the I/O interface 510.

The network 520 couples the headset 505 and/or the console 515 to the mapping server 525. The network 520 may include any combination of local area and/or wide area networks using both wireless and/or wired communication systems. For example, the network 520 may include the Internet, as well as mobile telephone networks. In one embodiment, the network 520 uses standard communications technologies and/or protocols. Hence, the network 520 may include links using technologies such as Ethernet, 802.11, worldwide interoperability for microwave access (WiMAX), 2G/3G/4G mobile communications protocols, digital subscriber line (DSL), asynchronous transfer mode (ATM), InfiniBand, PCI Express Advanced Switching, etc. Similarly, the networking protocols used on the network 520 can include multiprotocol label switching (MPLS), the transmission control protocol/Internet protocol (TCP/IP), the User Datagram Protocol (UDP), the hypertext transport protocol (HTTP), the simple mail transfer protocol (SMTP), the file transfer protocol (FTP), etc. The data exchanged over the network 520 can be represented using technologies and/or formats including image data in binary form (e.g. Portable Network Graphics (PNG)), hypertext markup language (HTML), extensible markup language (XML), etc. In addition, all or some of links can be encrypted using conventional encryption technologies such as secure sockets layer (SSL), transport layer security (TLS), virtual private networks (VPNs), Internet Protocol security (IPsec), etc.

The mapping server 525 may include a database that stores a virtual model describing a plurality of spaces, wherein one location in the virtual model corresponds to a current configuration of a local area of the headset 505. The mapping server 525 receives, from the headset 505 via the network 520, information describing at least a portion of the local area and/or location information for the local area. The mapping server 525 determines, based on the received information and/or location information, a location in the virtual model that is associated with the local area of the headset 505. The mapping server 525 determines (e.g., retrieves) one or more acoustic parameters associated with the local area, based in part on the determined location in the virtual model and any acoustic parameters associated with the determined location. The mapping server 525 may transmit the location of the local area and any values of acoustic parameters associated with the local area to the headset 505.

The foregoing description of the embodiments has been presented for illustration; it is not intended to be exhaustive or to limit the patent rights to the precise forms disclosed. Persons skilled in the relevant art can appreciate that many modifications and variations are possible considering the above disclosure.

Some portions of this description describe the embodiments in terms of algorithms and symbolic representations of operations on information. These algorithmic descriptions and representations are commonly used by those skilled in the data processing arts to convey the substance of their work effectively to others skilled in the art. These operations, while described functionally, computationally, or logically, are understood to be implemented by computer programs or equivalent electrical circuits, microcode, or the like. Furthermore, it has also proven convenient at times, to refer to these arrangements of operations as modules, without loss of generality. The described operations and their associated modules may be embodied in software, firmware, hardware, or any combinations thereof.

Any of the steps, operations, or processes described herein may be performed or implemented with one or more hardware or software modules, alone or in combination with other devices. In one embodiment, a software module is implemented with a computer program product comprising a computer-readable medium containing computer program code, which can be executed by a computer processor for performing any or all the steps, operations, or processes described.

Embodiments may also relate to an apparatus for performing the operations herein. This apparatus may be specially constructed for the required purposes, and/or it may comprise a general-purpose computing device selectively activated or reconfigured by a computer program stored in the computer. Such a computer program may be stored in a non-transitory, tangible computer readable storage medium, or any type of media suitable for storing electronic instructions, which may be coupled to a computer system bus. Furthermore, any computing systems referred to in the specification may include a single processor or may be architectures employing multiple processor designs for increased computing capability.

Embodiments may also relate to a product that is produced by a computing process described herein. Such a product may comprise information resulting from a computing process, where the information is stored on a non-transitory, tangible computer readable storage medium and may include any embodiment of a computer program product or other data combination described herein.

Finally, the language used in the specification has been principally selected for readability and instructional purposes, and it may not have been selected to delineate or circumscribe the patent rights. It is therefore intended that the scope of the patent rights be limited not by this detailed description, but rather by any claims that issue on an application based hereon. Accordingly, the disclosure of the embodiments is intended to be illustrative, but not limiting, of the scope of the patent rights, which is set forth in the following claims.

What is claimed is:

1. A system comprising:

one or more microphones configured to detect an audio signal in a local area surrounding the one or more microphones, the audio signal including a plurality of interferences of different interference types, each interference type in the different interference types being a classification of a sound source in the local area that emits a sound of the interference type; and an audio controller configured to:

for each of the plurality of interferences, estimate respective energy levels in a plurality of frequency bands; and apply an interference estimation algorithm to the estimated energy levels to generate an attenuation coefficient for each of the plurality of frequency bands;

for each of the plurality of frequency bands, combining the attenuation coefficients of the plurality of interferences of different interference types to determine a combined attenuation coefficient;

applying the combined attenuation coefficients of the plurality of frequency bands to the audio signal to generate an interference suppressed audio signal in which the plurality of interferences of different interference types is suppressed; and determine a time domain signal based on the interference-suppressed audio signal to provide to an end user.

2. The system of claim 1, wherein the audio controller is further configured to:

extract a set of respective features of the audio signal; and wherein the audio controller applies the interference estimation algorithm to the audio signal based in part on the set of respective features to generate an attenuation coefficient for each of a subset of interferences of the plurality of interferences of different interference types.

3. The system of claim 1, wherein the audio controller is further configured to divide the audio signal into a plurality of frequency bands, and wherein the audio controller applies the interference estimation algorithm to each of the plurality of frequency bands to generate an attenuation coefficient for each interference of the plurality of interferences of different interference types for each of the frequency bands.

4. The system of claim 1, wherein the audio controller is further configured to:

estimate an echo signal included in the audio signal, the echo signal including a linear portion and a nonlinear portion; and apply a filter to minimize the linear portion of the echo signal from the audio signal.

5. The system of claim 1, wherein the audio controller is further configured to detect a location characteristic of one or more location characteristics of the local area surrounding the one or more microphones, and wherein the audio controller applies the interference estimation algorithm to the audio signal based in part on the location characteristic to generate an attenuation coefficient for each of a subset of interferences of the plurality of interferences of different interference types.

6. The system of claim 1, wherein the audio controller is further configured to multiply the audio signal by the attenuation coefficients.

7. The system of claim 1, wherein the plurality of interferences of different interference types includes at least two of: a wind interference, an echo interference, a reverberation interference, a stationary interference, and a nonstationary interference.

8. The system of claim 1, wherein the end user is a user of a headset device and the time domain signal is presented to the user via a speaker assembly of the headset device as audio content.

9. The system of claim 1, wherein the end user is an electronic device.

10. The system of claim 1, wherein the audio controller is further configured to:

receive one or more captured images of the local area surrounding the one or more microphones;

detect one or more user gestures based in part on the captured images; and wherein the audio controller applies the interference estimation algorithm to the audio signal based in part on the one or more detected user gestures to generate an attenuation coefficient for each of a subset of interferences of the plurality of interferences of different interference types.

11. A method comprising:

detecting an audio signal with one or more microphones in a local area surrounding the one or more microphones, the audio signal including a plurality of interferences of different interference types, each interference type in the different interference types being a classification of a sound source in the local area that emits a sound of the interference type;

for each of the plurality of interferences, estimating respective energy levels in a plurality of frequency bands; and applying an interference estimation algorithm to the estimated energy levels to generate an attenuation coefficient for each of the plurality of frequency bands;

for each of the plurality of frequency bands, combining the attenuation coefficients of the plurality of interferences of different interference types to determine a combined attenuation coefficient;

applying the combined attenuation coefficients of the plurality of frequency bands to the audio signal to generate an interference suppressed audio signal in which the plurality of interferences of different interference types is suppressed; and determining a time domain signal based on the interference-suppressed audio signal to provide to an end user.

12. The method of claim 11, further comprising:

extracting a set of respective features of the audio signal; and wherein applying the interference estimation algorithm to the audio signal further comprises:

based on the set of respective features, applying the interference estimation algorithm to the audio signal to generate an attenuation coefficient for each of a subset of interferences of the plurality of interferences of different interference types.

13. The method of claim 11, further comprising dividing the audio signal into a plurality of frequency bands, and wherein applying the interference estimation algorithm to the audio signal further comprises:

applying the interference estimation algorithm to each of the plurality of frequency bands to generate an attenuation coefficient for each interference of the plurality of interferences of different interference types for each of the frequency bands.

14. The method of claim 11, further comprising:

estimating an echo signal included in the audio signal, the echo signal including a linear portion and a nonlinear portion; and applying a filter to minimize the linear portion of the echo signal from the audio signal prior to applying the interference estimation algorithm.

15. The method of claim 11, further comprising:

detecting a location characteristic of one or more locations characteristics of the local area surrounding the one or more microphones; and wherein applying the interference estimation algorithm to the audio signal further comprises:

based on the location characteristic, applying the interference estimation algorithm to the audio signal to generate an attenuation coefficient for each of a subset of interferences of the plurality of interferences of different interference types.

16. The method of claim 11, wherein jointly applying the attenuation coefficients to the audio signal to generate the interference-suppressed audio signal comprises multiplying the audio signal by the attenuation coefficients.

17. The method of claim 11, further comprising:

receiving one or more captured images of a local area surrounding the one or more microphones;

detecting one or more user gestures based in part on the captured images; and wherein applying the interference estimation algorithm to the audio signal further comprises:

based on the one or more detected user gestures, applying the interference estimation algorithm to the audio signal to generate an attenuation coefficient for each of a subset of interferences of the plurality of interferences of different interference types.

18. A non-transitory computer-readable storage medium storing instructions that, when executed by one or more processors, cause the one or more processors to perform operations comprising:

detecting an audio signal with one or more microphones in a local area, the audio signal including a plurality of interferences of different interference types, each interference type in the different interference types being a classification of a sound source in the local area that emits a sound of the interference type;

for each of the plurality of interferences, estimating respective energy levels in a plurality of frequency bands; and applying an interference estimation algorithm to the estimated energy levels to generate an attenuation coefficient for each of the plurality of frequency bands;

for each of the plurality of frequency bands, combining the attenuation coefficients of the plurality of interferences of different interference types to determine a combined attenuation coefficient;

applying the combined attenuation coefficients of the plurality of frequency bands to the audio signal to generate an interference suppressed audio signal in which the plurality of interferences of different interference types is suppressed; and determining a time domain signal based on the interference-suppressed audio signal to provide to an end user.

19. The non-transitory computer-readable storage medium of claim 18, the instructions further cause the one or more processors to perform operations further comprising:

extracting a set of respective features of the audio signal; and wherein applying the interference estimation algorithm to the audio signal further comprises:

based on the set of respective features, applying the interference estimation algorithm to the audio signal to generate an attenuation coefficient for each of a subset of interferences of the plurality of interferences of different interference types.

20. The non-transitory computer-readable storage medium of claim 18, the instructions further cause the one or more processors to perform operations further comprising:

dividing the audio signal into a plurality of frequency bands; and wherein applying the interference estimation algorithm to the audio signal further comprises applying the interference estimation algorithm to each of the plurality of frequency bands to generate an attenuation coefficient for each interference of the plurality of interferences of different interference types for each of the frequency bands.

* * * * *